US011280121B2

(12) United States Patent
Sardelli et al.

(10) Patent No.: US 11,280,121 B2
(45) Date of Patent: Mar. 22, 2022

(54) CRASH UNLOCK FOR SIDE DOOR LATCH

(71) Applicant: MAGNA CLOSURES INC., Newmarket (CA)

(72) Inventors: Dunia Sardelli, Leghorn (IT); Marco Taurasi, Leghorn (IT); Francesco Cumbo, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 474 days.

(21) Appl. No.: 16/291,054

(22) Filed: Mar. 4, 2019

(65) Prior Publication Data

US 2019/0271180 A1 Sep. 5, 2019

Related U.S. Application Data

(60) Provisional application No. 62/638,565, filed on Mar. 5, 2018.

(51) Int. Cl.

| | |
|---|---|
| ***E05B 81/90*** | (2014.01) |
| ***E05B 81/14*** | (2014.01) |
| ***E05B 81/36*** | (2014.01) |
| ***E05B 15/00*** | (2006.01) |
| ***E05B 77/02*** | (2014.01) |

(52) U.S. Cl.

CPC ..... *E05B 81/90* (2013.01); *E05B 15/004* (2013.01); *E05B 77/02* (2013.01); *E05B 81/14* (2013.01); *E05B 81/36* (2013.01); *E05Y 2900/531* (2013.01)

(58) Field of Classification Search

CPC ..... E05B 81/14; E05B 81/36; E05B 81/90; E05B 77/02; E05B 15/004; Y10T 292/1047; Y10T 292/1082; Y10S 292/23

See application file for complete search history.

(56) References Cited

U.S. PATENT DOCUMENTS

| | | | | |
|---|---|---|---|---|
| 5,649,726 | A * | 7/1997 | Rogers, Jr. | E05B 81/44 292/201 |
| 5,802,894 | A * | 9/1998 | Jahrsetz | E05B 77/48 292/144 |
| 6,499,776 | B2 | 12/2002 | Takamura | |
| 6,648,379 | B1 * | 11/2003 | Kordowski | E05B 81/14 292/201 |
| 7,287,785 | B2 | 10/2007 | Schupp et al. | |

(Continued)

FOREIGN PATENT DOCUMENTS

| | | | |
|---|---|---|---|
| CN | 103089087 | A | 5/2013 |
| CN | 106246013 | A | 12/2016 |

(Continued)

*Primary Examiner* — Christine M Mills
*Assistant Examiner* — Christopher F Callahan
(74) *Attorney, Agent, or Firm* — Dickinson Wright PLLC

(57) ABSTRACT

A power latch assembly for motor vehicle closure applications is provided that is normally actuated via electrical signals whereat inside and outside door handles are mechanically disengaged and wherein the inside and outside door handles can be selectively and/or automatically changed for mechanically engaged actuation. The inside door handles can be provided to be mechanically actuatable in direct response to selective disengagement of a child lock. The outside door handles can be provided to be mechanically actuatable in direct response to a crash condition.

20 Claims, 20 Drawing Sheets

(56) References Cited

U.S. PATENT DOCUMENTS

| | | | | |
|---|---|---|---|---|
| 10,132,107 | B2 | 11/2018 | Tomaszewski | |
| 2003/0116977 | A1* | 6/2003 | Erices | E05B 81/06 292/201 |
| 2016/0010365 | A1* | 1/2016 | Hanaki | E05B 81/90 292/21 |
| 2016/0076277 | A1 | 3/2016 | Kouzuma et al. | |
| 2017/0074008 | A1 | 3/2017 | Marlia et al. | |
| 2017/0107747 | A1 | 4/2017 | Dente et al. | |
| 2017/0159331 | A1* | 6/2017 | Handke | E05B 81/14 |
| 2017/0342749 | A1* | 11/2017 | Nelson | E05B 79/10 |
| 2018/0016821 | A1 | 1/2018 | Cumbo et al. | |
| 2018/0155965 | A1* | 6/2018 | Estrada | E05B 81/20 |
| 2018/0355643 | A1 | 12/2018 | Taurasi | |

FOREIGN PATENT DOCUMENTS

| | | | |
|---|---|---|---|
| CN | 107339030 | A | 11/2017 |
| CN | 107461088 | A | 12/2017 |
| DE | 19750979 | A1 | 6/1999 |
| DE | 19822548 | A1 | 11/1999 |
| DE | 19611578 | B4 | 3/2008 |
| EP | 1320652 | B1 | 6/2003 |
| EP | 2820216 | B1 | 1/2015 |

* cited by examiner

FIG. 3C
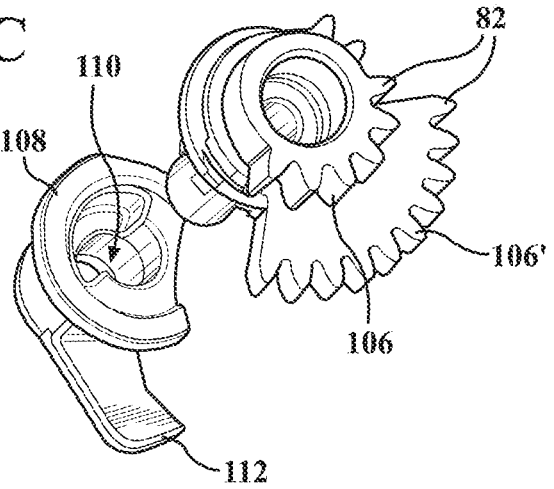
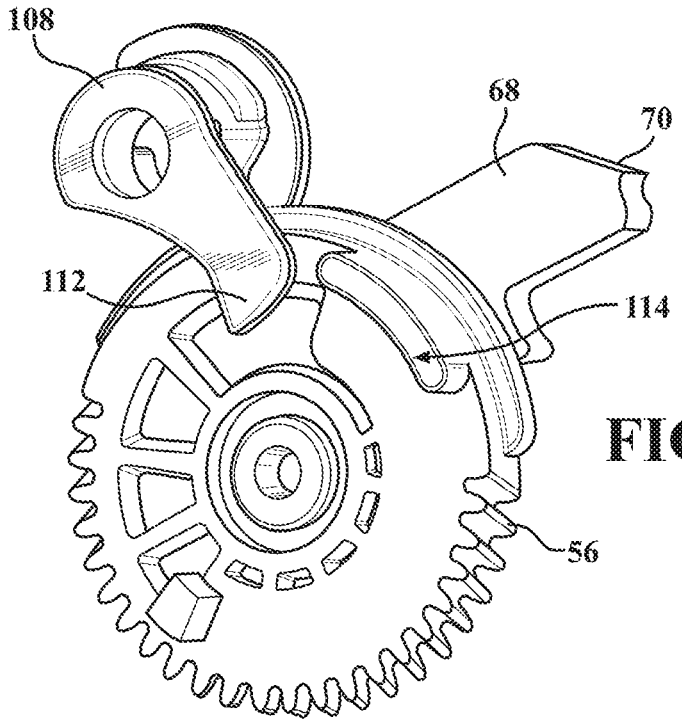
FIG. 3D
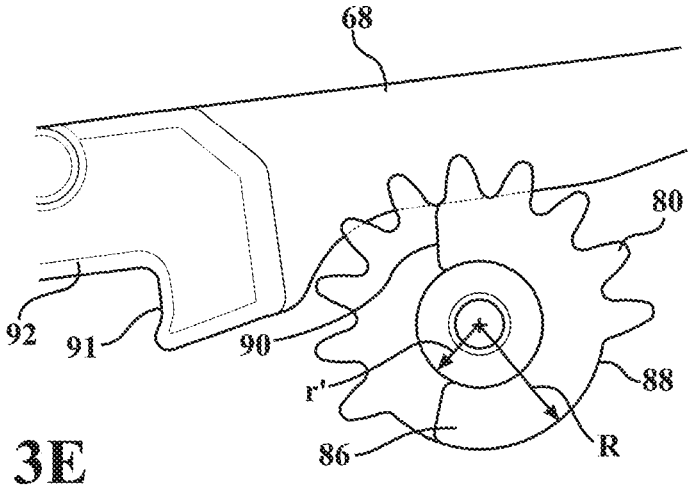
FIG. 3E

CRASH UNLOCK FOR SIDE DOOR LATCH

CROSS-REFERENCE TO RELATED APPLICATION

This application claims the benefit of U.S. Provisional Application Ser. No. 62/638,565, filed Mar. 5, 2018, which is incorporated herein by reference in its entirety.

FIELD

The present disclosure relates generally to automotive door latches, and more particularly, to a power side door latch assembly equipped with a door handle mechanical release mechanism.

BACKGROUND

This section provides background information related to automotive door latches and is not necessarily prior art to the concepts associated with the present disclosure.

A vehicle closure panel, such as a side door for a vehicle passenger compartment, is hinged to swing between open and closed positions and includes a latch assembly mounted to the door. The latch assembly functions in a well-known manner to latch the door when it is closed, lock the door in its closed position, and unlatch and release the door to permit subsequent movement of the door to its open position. As is also well known, the latch assembly is configured to include a latch mechanism for latching the door, a lock mechanism interacting with the latch mechanism for locking the door, and a release mechanism interacting with the lock mechanism for unlocking and unlatching the door. These mechanisms can be manually-operated via an inside and outside door handle and/or power-operated to provide the desired level of standard features. In known latch assemblies, if the latch mechanism is both power and mechanically actuatable, the ability to utilize power and mechanical release mechanisms continuously coexist, such that the user can use either the power or mechanical mechanism at any time to actuate the latch mechanism. Accordingly, the latch mechanism can be unlatched via power or mechanical actuation of the inside and outside doors handle at any time.

It is desired to have a latch mechanism that is actuatable in normal operating conditions via powered actuation, while simultaneously remaining unactuatable via mechanical actuation of the inside and outside door handles. However, it is also desired to be able to selectively or automatically alter the latch mechanism so that it can be manually actuated via the inside and outside door handles, such as when a child lock is disengaged or in a crash condition, or at some other desired time to allow the door to be manually opened.

Thus, there remains a need to develop alternative arrangements for latch mechanisms for use in vehicular side door latches which selectively alter the latch mechanism so that it remains solely actuatable via power actuation in normal operating conditions and selectively or automatically transitioned for mechanical actuation when desired.

SUMMARY

This section provides a general summary of the disclosure, and is not intended to be a comprehensive and exhaustive listing of all of its features or its full scope.

It is an object of the present disclosure to provide a power latch assembly for motor vehicle closure applications that is normally actuated via electrical signals whereat inside and outside door handles are mechanically disengaged and wherein the inside and outside door handles can be selectively and/or automatically changed for mechanically engaged actuation.

In accordance with another object of the disclosure, the inside door handles can be provided to be mechanically actuatable in direct response to selective disengagement of a child lock.

In accordance with another object of the disclosure, the outside door handles can be provided for automated mechanical actuation in direct response to a crash condition.

In accordance with the above objects, one aspect of the disclosure provides a power latch assembly for a vehicle door including a ratchet configured for movement between striker capture and striker release positions and being biased toward the striker release position. The power latch assembly includes a pawl configured for movement between a ratchet holding position whereat the pawl maintains the ratchet in the striker capture position and a ratchet releasing position whereat the pawl releases the ratchet to the striker release position. A pawl release lever is configured to selectively move the pawl between the ratchet holding position and the ratchet releasing position. A release mechanism is configured for mechanical actuation by at least one of an inside door handle and an outside door handle, wherein the release mechanism is moveable between a disengaged position, whereat the release mechanism is disengaged from operable communication with the pawl release lever, and an engaged position, whereat the release mechanism is engaged in operable communication with the pawl release lever. The power latch assembly further includes a power release actuator system configured to control powered actuation of the pawl release lever to move the pawl between the ratchet holding position and the ratchet releasing position and to maintain the release mechanism in the disengaged position during normal operation of the latch assembly and to selectively move the release mechanism to the engaged position.

According to another aspect of the present disclosure the power latch assembly can be provided including a motor and a drive gear driven by the motor, with the drive gear being in meshed engagement with a power release gear having a release cam fixed thereto. Further, an actuator output lever can be configured for movement in response to movement of the release cam, wherein the actuator output lever is configured to move the pawl release lever to move the pawl between the ratchet holding and releasing positions.

According to another aspect of the present disclosure the release mechanism of the power latch assembly can be provided including a release lever operably connected with at least one of the inside and outside door handle and a link lever configured for movement in response to movement of the release lever. The link lever being moveable to a decoupled position with the actuator output lever to maintain the release mechanism in the disengaged position during normal operation of the latch assembly and to a coupled position with the actuator output lever to move the release mechanism to the engaged position.

According to another aspect of the present disclosure the latch assembly can be provided including a cam lobe operably fixed to the power release gear for conjoint rotation therewith, with the cam lobe maintaining the link lever in the decoupled position with the actuator output lever to maintain the release mechanism in the disengaged position during normal operation of the latch assembly and moving the link lever to the coupled position with the actuator output lever to move the release mechanism to the engaged position either selectively or in automated response to a crash condition.

According to another aspect of the present disclosure the power release gear can be provided to rotate in a first direction from a neutral position to an unlatched position to cause the actuator output lever to move the pawl release lever into engagement with the pawl to move the pawl to the ratchet releasing position and the power release gear can be provided to rotate in a second direction opposite the first direction from the unlatched position to the neutral position to allow the pawl to return to the ratchet holding position. The power release gear can further be provided to rotate from the neutral position in the second direction to cause the cam lobe to move the link lever from the decoupled position to the coupled position with the actuator output lever to move the release mechanism to the engaged position.

According to another aspect of the present disclosure the power latch assembly can be provided to include a control unit in electrical communication with the motor, with the control unit being configured in electrical communication with at least one sensor configured to detect a crash condition, wherein the control unit automatically energizes the motor in response to a detected crash condition to move the power release gear from the neutral position in the second direction to the to cause the cam lobe to move the link lever from the decoupled position to the coupled position with the actuator output lever to move the release mechanism to the engaged position.

According to another aspect of the present disclosure the power latch assembly can a first gear configured in meshed engagement with a second gear, and a third gear configured for driven engagement with the power release gear and in meshed engagement with the second gear, with the cam lobe being fixed to the first gear for conjoint rotation therewith.

According to another aspect of the present disclosure the third gear can be provided having a lost-motion connection with the power release gear to allow the power release gear to from the neutral position to the unlatched position to cause the actuator output lever to move the pawl release lever into engagement with the pawl to move the pawl to the ratchet releasing position and to rotate in a second direction opposite the first direction from the unlatched position to the neutral position to allow the pawl to return to the ratchet holding position, and further, to rotate from the neutral position in the second direction to cause the cam lobe to move the link lever from the decoupled position to the coupled position with the actuator output lever to move the release mechanism to the engaged position.

According to another aspect of the present disclosure the third gear can be configured for movement of the link lever to the coupled position with the actuator output lever to move the release mechanism to the engaged position in the absence of power to the power release motor.

According to another aspect of the present disclosure the third gear formed having an actuation lever with the power latch assembly further including a lock knob configured for receipt in a fishmouth of the vehicle door. The lock knob can be configured for receipt of a vehicle key for selective movement of the lock knob into engagement with the actuation lever to move the link lever to the coupled position with the actuator output lever to move the release mechanism to the engaged position.

According to another aspect of the present disclosure, there is provided a method of operating a power latch assembly for a vehicle door, the method including the steps of operating a prime mover configured to control powered actuation of an power release actuator system comprising a pawl and a ratchet during a normal mode of the power latch assembly to move said pawl from a ratchet holding position to a ratchet releasing position and to maintain an override release mechanism in a disengaged state whereat said override release mechanism operably decouples at least one of an inside door handle and an outside door handle from said pawl, and operating the prime mover during a manual mode of the power latch assembly to transition the override release mechanism to an engaged state whereat said override release mechanism operably couples at least one of the inside door handle and the outside door handle with the pawl.

According to yet another aspect of the present disclosure, there is provided a power latch assembly for a vehicle door, including a ratchet configured for movement between a striker capture position and a striker release position and being biased toward said striker release position, a pawl configured for movement between a ratchet holding position whereat said pawl maintains said ratchet in said striker capture position and a ratchet releasing position whereat said pawl releases said ratchet for movement of said ratchet to said striker release position, an override release mechanism configured for mechanical actuation by at least one of an inside door handle and an outside door handle and being moveable between a disengaged state, whereat said override release mechanism is disengaged from operable communication with said pawl, and an engaged state, whereat said override release mechanism is engaged in operable communication with said pawl, a prime mover configured to control powered actuation of said pawl release lever to move said pawl from said ratchet holding position to said ratchet releasing position and to maintain said override release mechanism in said disengaged state during normal operation of the power latch assembly and to selectively move said override release mechanism to said engaged state, and a controller configured to control activation of said prime mover in response to determining an operating mode of the power latch assembly.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

These and other aspects, features, and advantages of the present disclosure will be readily appreciated, as the same becomes better understood by reference to the following detailed description when considered in connection with the accompanying drawings wherein:

FIGS. 3A-3G illustrate various components of the mechanical override system of FIG. 3;

Corresponding reference numerals are used throughout all of the drawings to indicate corresponding parts.

DETAILED DESCRIPTION OF EXAMPLE EMBODIMENTS

Figure 1:
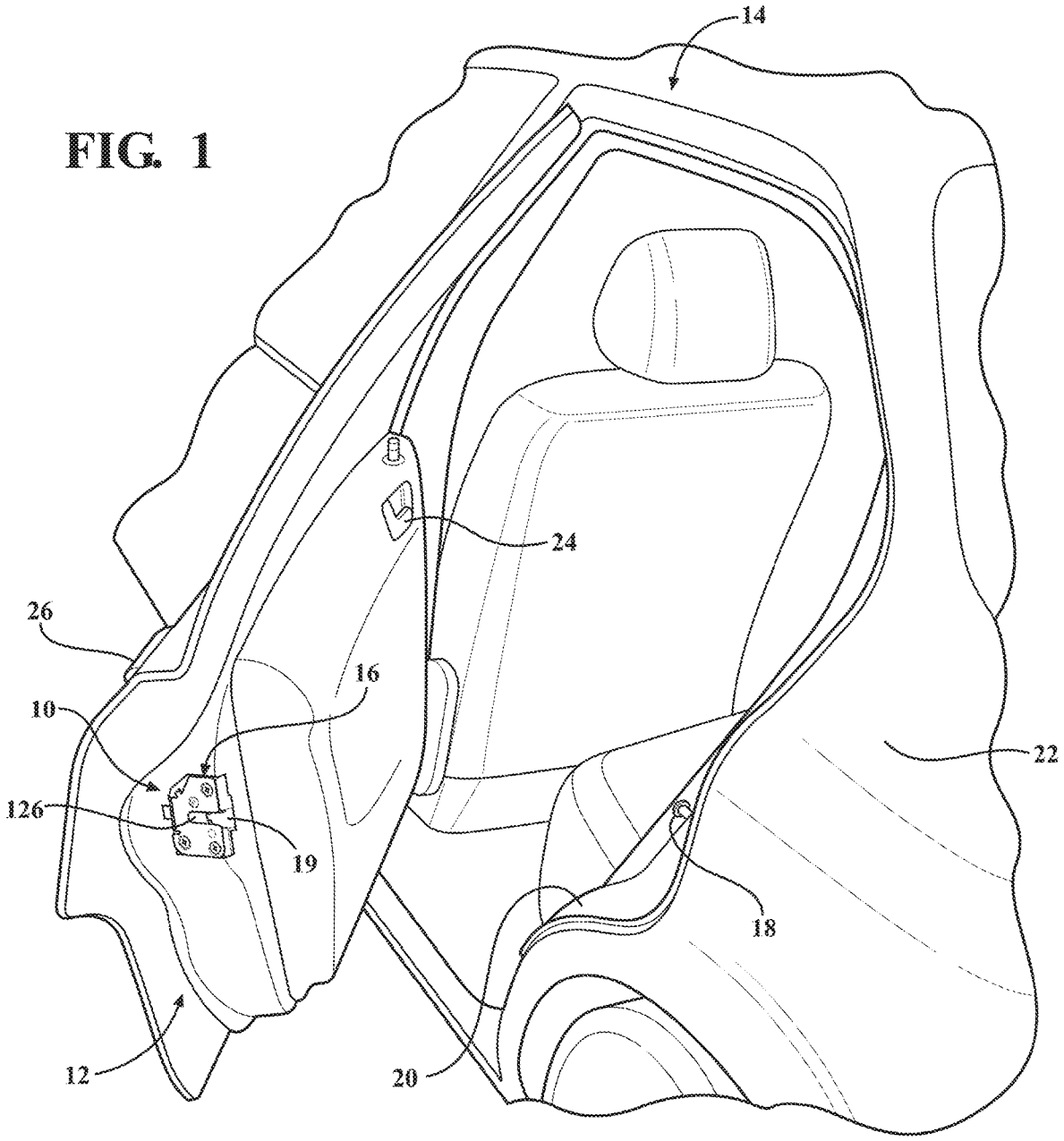
FIG. 1 is a partial perspective view of a motor vehicle having a side door equipped with a power latch assembly embodying the teachings of the present disclosure.

One or more example embodiments of a latch assembly of the type well-suited for use in motor vehicle closure systems will now be described with reference to the accompany drawings. However, these example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by a skilled artisan.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Referring initially to FIG. 1, a non-limiting example of a power latch assembly, referred to hereafter simply as latch assembly 10, installed in a closure panel, such as, by way of example and without limitation, a passenger side swing door 12 of a motor vehicle 14, is shown. Latch assembly 10 includes a latch mechanism 16 configured to releasably latch and hold a striker 18 mounted to a sill portion 20 of vehicle body 22 when swing door 12 is closed. Latch assembly 10 can be selectively actuated via an inside door handle 24, an outside door handle 26, and a key fob 28. As will be detailed, latch assembly 10 is configured to be power-operated in a normal use state and under normal conditions, with inside door handle 24 remaining mechanically disengaged while in a child lock state and outside door handle 26 remaining mechanically disengaged during normal use conditions, such that the inside door handle 24 and outside door handle 26 are normally ineffective for mechanical actuation of latch mechanism 16 during a child lock state and while in normal use. However, the inside door handle 24 can be selectively mechanically coupled within latch mechanism 16, such as via selective actuation by a vehicle driver or occupant having access to an actuation device (not shown), e.g. button in proximity to the vehicle driver, as may be desired to override the child lock state of a rear passenger door, by way of example and without limitation, and outside door handle 26 can be configure to be automatically mechanically coupled with latch mechanism 16 in a crash condition via a mechanical override release system, referred to hereafter as override release mechanism or release mechanism 29, such that latch mechanism 16 can be manually and mechanically actuated via inside door handle 24 and outside door handle 26, when desired, and thereafter, inside door handle 24 and outside door handle 26 can be selectively and automatically returned to their respective normal use positions, as discussed in further detail below.

Figure 2A:
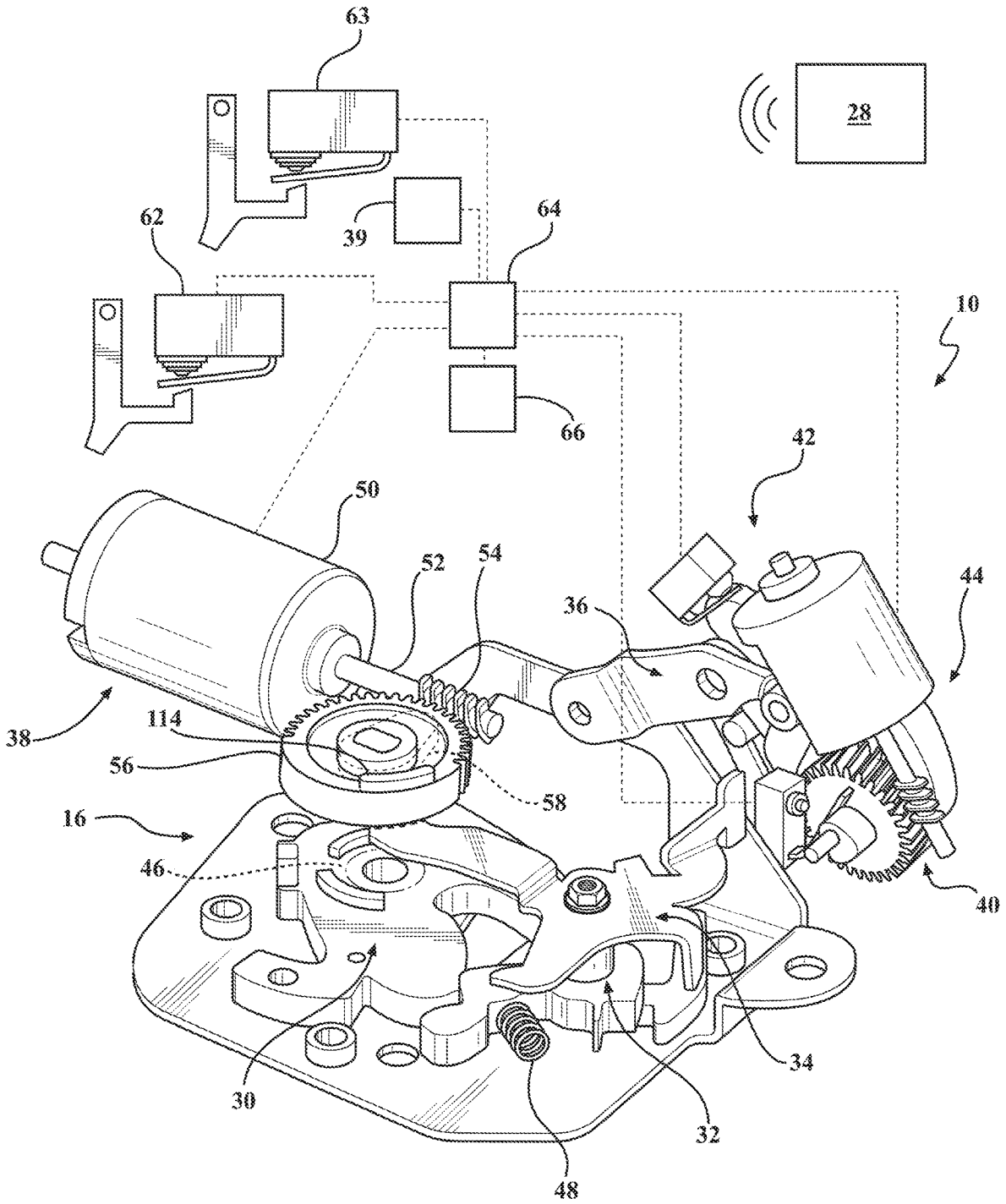
FIG. 2A is a schematic view of a power latch assembly embodying the teachings of the present disclosure, with some components removed for clarity purposes only.
Figure 2C:
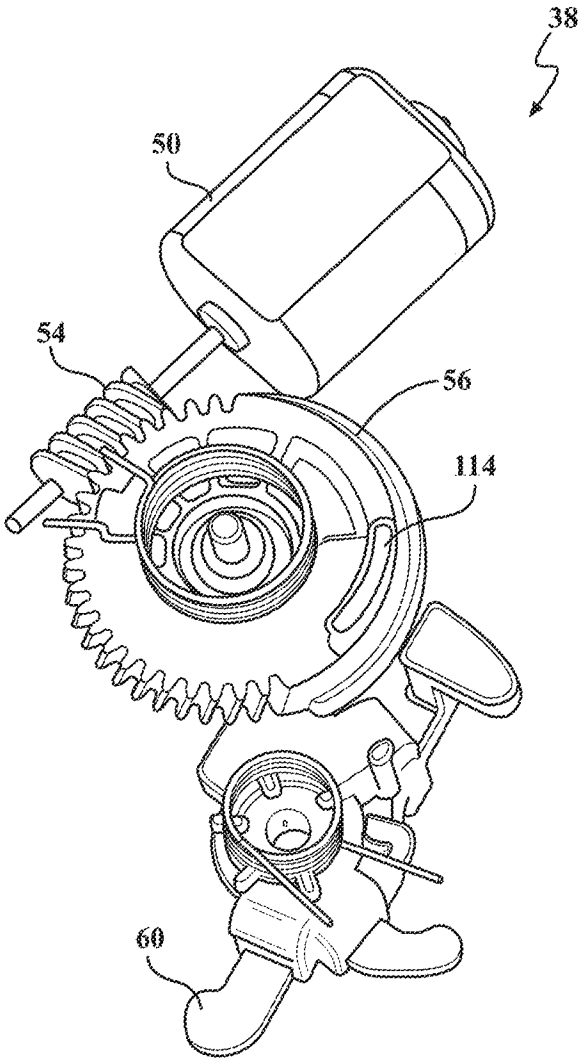
FIGS. 2B and 2C illustrated opposite sides of a power latch assembly embodying the teachings of the present disclosure, with some components removed for clarity purposes only.
Figure 2B:
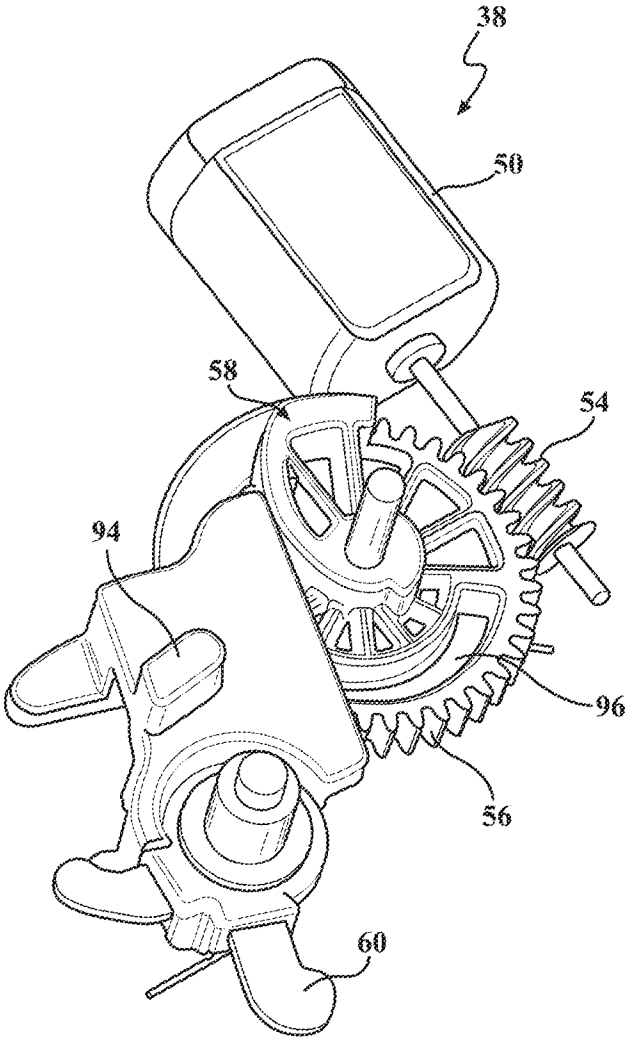

Referring to FIG. 2A, shown is a non-limiting embodiment of latch assembly 10 and latch mechanism 16, with some components, discussed below, removed for clarity purposes, having a ratchet 30 and a pawl 32, a latch release mechanism having a pawl release lever 34, an inside door release mechanism and an outside door release mechanism having a common inside/outside release lever, referred to hereafter simply as release lever 36, by way of example and without limitation, operably connected to inside door handle 24 and outside door handle 26 for selective mechanical operation, a power release actuator system 38 for controlling powered actuation of the latch release mechanism 16, and a power lock actuator 40 having a lock mechanism 42 and an electric lock motor 44. Ratchet 30 is movable between a striker capture position (shown in FIG. 2A) whereat ratchet 30 retains striker 18 and swing door 12 in closed position, and a striker release position (FIG. 1) whereat ratchet 30 permits release of striker 18 from a fishmouth 19 provided by a latch housing of latch assembly 10 to allow movement of swing door 12 to the open position. A ratchet biasing member 46, such as a spring, is provided to normally bias ratchet 30 toward its striker release position. Pawl 32 is movable between a ratchet holding position whereat pawl 32 holds ratchet 30 in its striker capture position, and a ratchet releasing position whereat pawl 32 permits ratchet 30 to move to its striker release position. A pawl biasing member 48, such as a suitable spring, is provided to normally bias pawl 32 toward its ratchet holding position.

Pawl release lever 34 is operatively connected to pawl 32 and is movable between a pawl release position whereat pawl release lever 34 moves pawl 32 to its ratchet releasing position, and a home position whereat pawl release lever 34 permits pawl 32 to be in its ratchet holding position. A release lever biasing member (not shown), such as a suitable spring, can be provided to normally bias pawl release lever 34 toward its home position. Pawl release lever 34 can be moved to its pawl release position by several components, such as, for example, by power release actuator system 38, by release lever 36. Power release actuator system 38 includes a motor, referred to as power release motor 50, having an output shaft 52, with a drive gear, also referred to as power release gear, shown as a power release worm gear 54 mounted on output shaft 52, by way of example and without limitation, and a power release gear 56. A power release cam 58 is connected for conjoint rotation with power release gear 56 and is rotatable between a pawl release range of positions and a pawl non-release range of positions. In FIG. 2A, power release cam 58 is located in a position that is within the pawl non-release range. Power release gear 56 is driven by power release worm gear 54 for driving power release cam 58 which, in turn, drives an actuator output lever 60 (FIGS. 2B, 2C, 3-3B, 3F and 4) which drives pawl release lever 34 from its home position into its pawl release position.

Power release actuator system 38 can be used as part of a conventional passive keyless entry feature. When a person approaches vehicle 14 with electronic key fob 28 (FIG. 2A) and actuates the outside door handle 26, for example, sensing both the presence of key fob 28 and that outside door handle 26 has been actuated (e.g. via electronic communication between an electronic switch 62 (FIG. 2A, wherein inside door handle 24 also is actuatable via an electronic switch 63) and a latch electronic control unit (ECU) shown at 64 that at least partially controls the operation of latch assembly 10). In turn, latch ECU 64 actuates power release actuator system 38 to cause the actuator output lever 60 to release the latch mechanism 16 and shift latch assembly 10 into an unlatched operating state so as to facilitate subsequent opening of vehicle swing door 12. Power release actuator system 38 can be alternatively activated as part of a proximity sensor based entry feature (radar based proximity detection for example), for example when a person approaches vehicle 14 with electronic key fob 28 (FIG. 2A) and actuates a proximity sensor 66, such as a capacitive sensor, or other touch/touchless based sensor (based on a recognition of the proximity of an object, such as the touch/swipe/hover/gesture or a hand or finger), (e.g. via communication between the proximity sensor 66 and latch ECU 64 that at least partially controls the operation of latch assembly 10). In turn, if detecting a normal use condition, such as the presence of electronic key fob 28, by way of example and without limitation, latch ECU 64 actuates power release actuator system 38 to release the latch mechanism 16 and shift latch assembly 10 into an unlatched operating state so as to facilitate subsequent opening of vehicle door 12, as discussed above. Further, if detecting an other than normal use condition, such as an intentional selective override of a child latch state and/or a crash condition, latch ECU 64 actuates power release actuator system 38 to bring inside door handle 24 and outside door handle 26 into mechanically connected relation with actuator output lever 60, thereby allowing mechanical actuation of inside door handle 24 and outside door handle 26 to release the latch mechanism 16 and shift latch assembly 10 into an unlatched operating state so as to facilitate subsequent opening of vehicle door 12.

Referring in more detail to the mechanical override system 29, a plurality of gear members and associated levers/cams/spring members are brought into selective communication to allow selective mechanical actuation of inside door handle 24, such as when a child lock state has been intentionally unlocked/disengaged or when a double lock state has been unlocked/disabled, and to automatically allow mechanical actuation of outside door handle 26, such as upon a crash condition. In normal use conditions (i.e., the car is in a normal driving condition and not in a crash condition), and while the child lock state is locked/engaged, inside and outside door handles 24, 26 are in an operably, mechanically disconnected state from actuator output lever 60, and thus, mechanical actuation of the inside and outside door handles 24, 26 does not cause pawl release lever 34 to move pawl 32 to its ratchet releasing position. Accordingly, the pawl 32 remains in its ratchet holding position. However, if the child lock has been selectively disengaged, as discussed above, such as via an electrically actuatable button or other electrically actuatable device, mechanical override system 29 moves an inside/outside link lever, referred to hereafter simply as link lever 68, into alignment for engagement with actuator output lever 60, thereby allowing mechanical actuation of the inside door handle 24 to cause pawl release lever 34 to move pawl 32 to its ratchet releasing position. Accordingly, the pawl 32 moves to its ratchet releasing position, thereby allowing swing door 12 to be opened via pure mechanical actuation. Similarly, if the motor vehicle 14 has been involved in a crash, mechanical override system 29 is signaled, via aforementioned sensors/detection systems such as a body control module (BCM) 39, to automatically move link lever 68 into engagement with actuator output lever 60, thereby allowing mechanical actuation of the outside door handle 26 to cause pawl release lever 34 to move pawl 32 to its ratchet releasing position. Accordingly, the pawl 32 moves via pure mechanical actuation of outside door handle 26 to its ratchet releasing position, thereby allowing swing door 12 to be opened.

Figure 3:
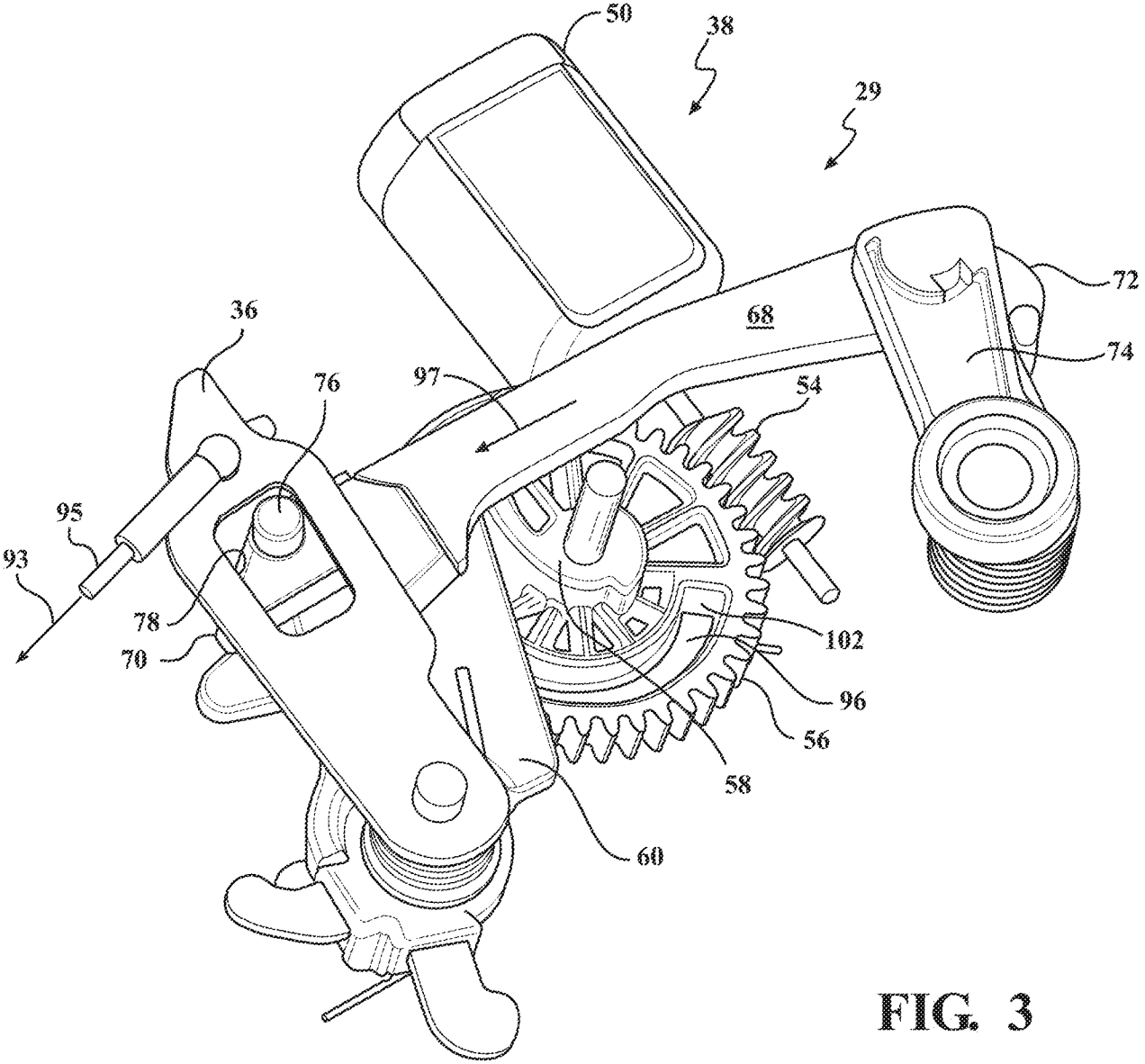
FIG. 3 is a perspective view of a mechanical override system of a power latch assembly embodying the teachings of the present disclosure, with some components removed for clarity purposes only.
Figure 3A:
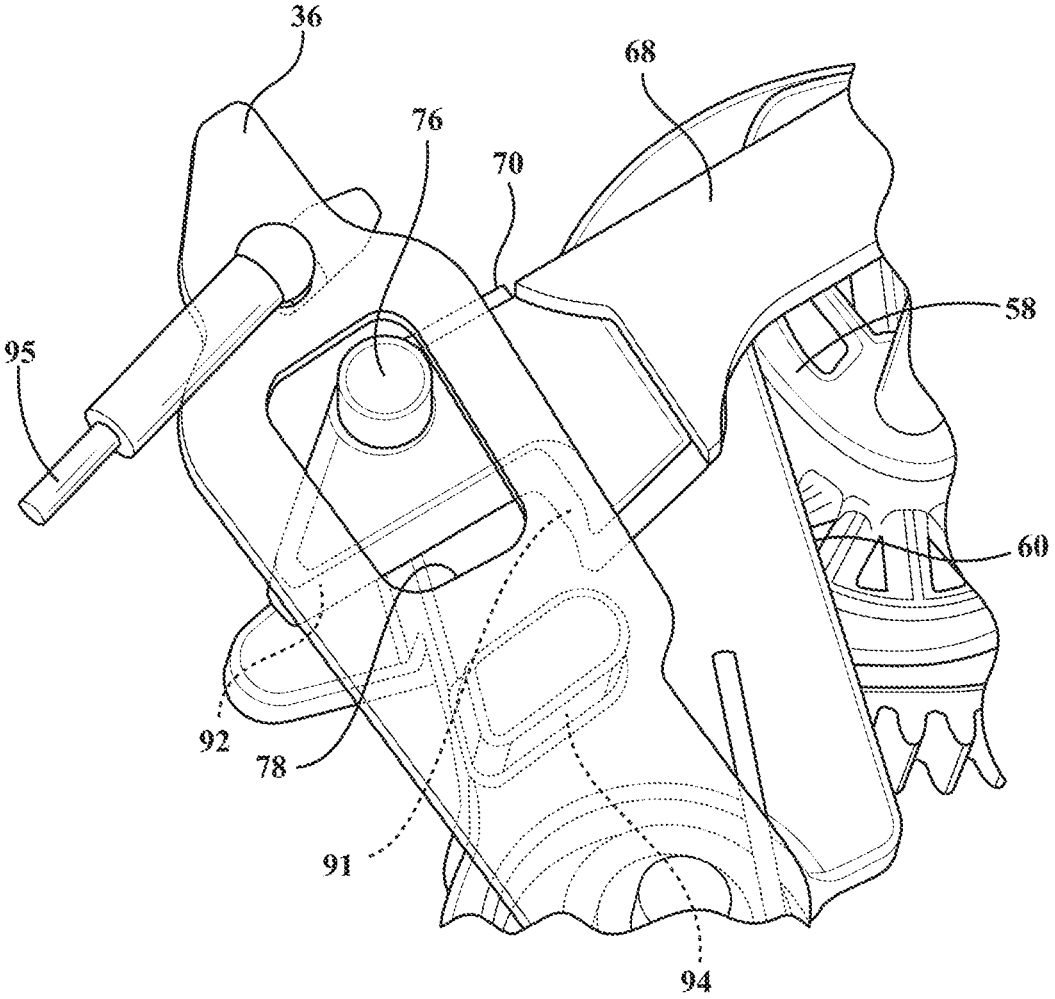
Figure 3B:
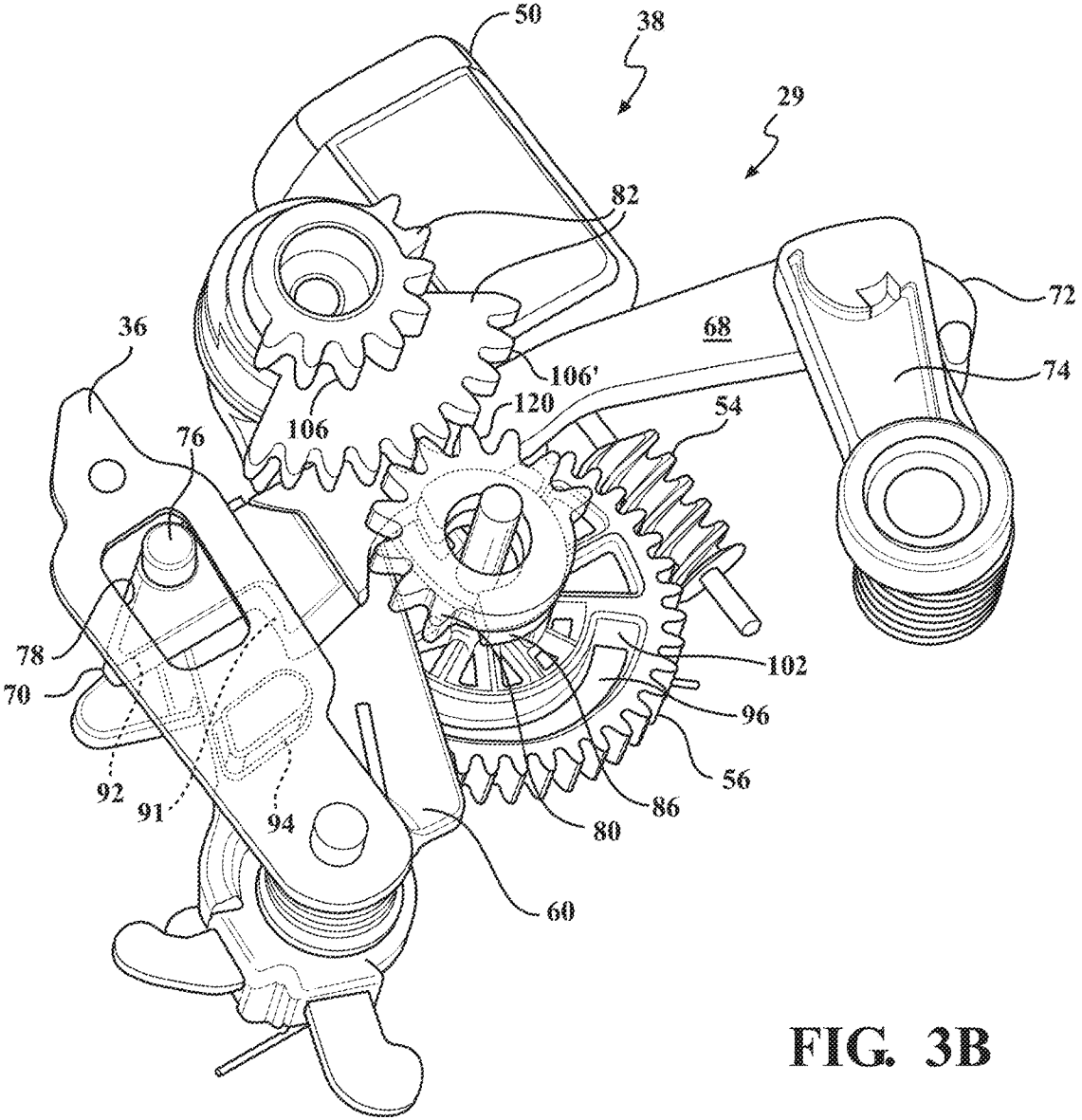
Figure 3F:
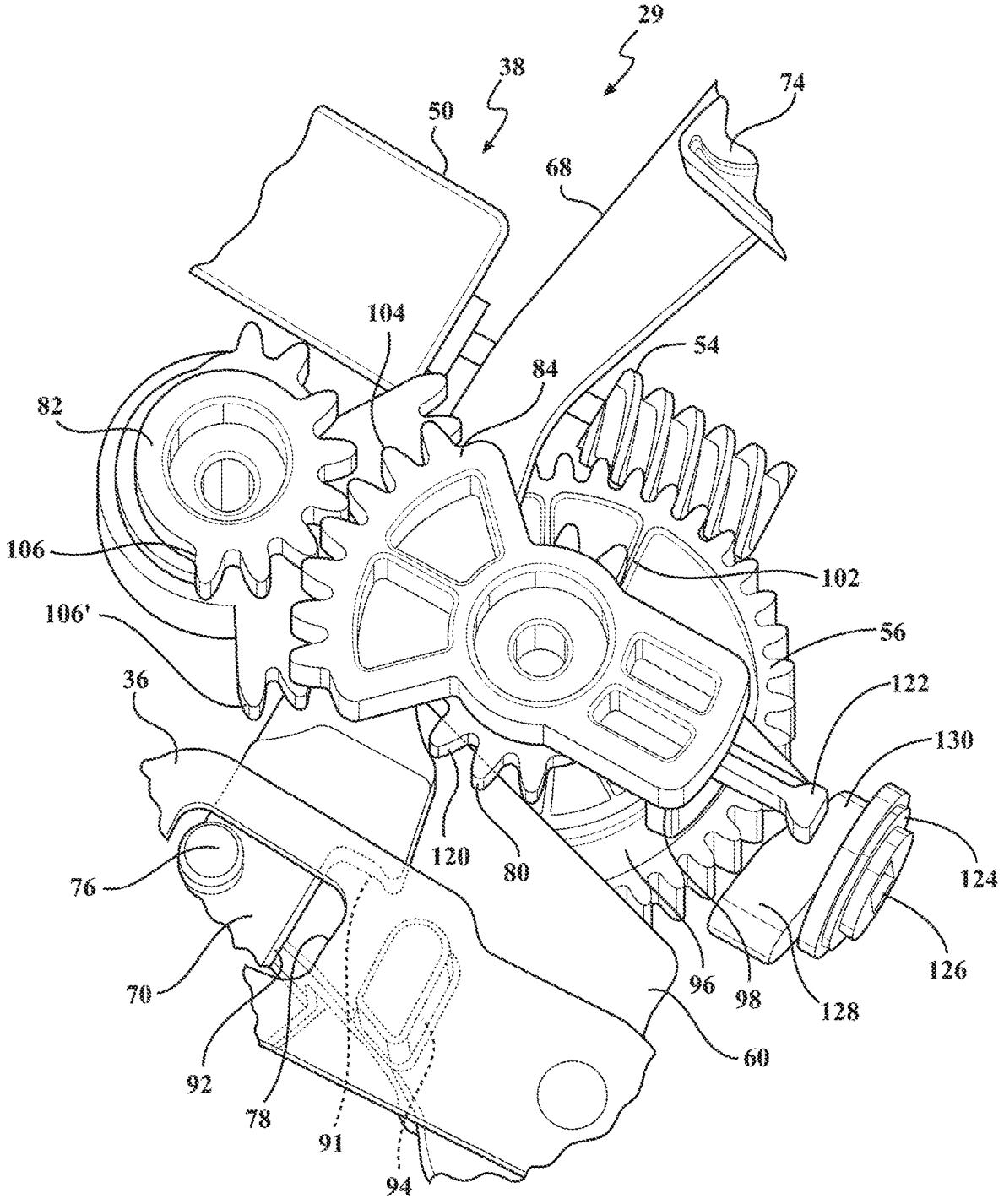

Referring to FIG. 3, link lever 68 has a first end 70 operably coupled to release lever 36 for selective, automated movement between an engaged state and a disengaged state, and has a second end 72 pivotably coupled to an auxiliary lever 74. Auxiliary lever 74 serves as a support member to link lever 68 to allow link lever 68 to translate upon actuation of inside and outside door handles 24, 26, and to allow link lever 68 to pivot between its engaged and disengaged states. As such, the second end 72 is solely pivotal relative to auxiliary lever 74. Contrarily, the first end 70 of link lever 68 is operably coupled to release lever 36 to move in translation relative thereto between the engaged/coupled and disengaged/decoupled states, and is shown in a non-limiting embodiment as having a laterally extending protrusion or lug 76 received in an opening, also referred to as window 78, of release lever 36 for selective upward movement within the window 78 to the disengaged/decoupled state and for selective downward movement within the window 78 to the engaged/coupled state, as viewed the figures. As such, the window 78 is enlarged relative to the girth (such as a cross-sectional width or diameter, if round) of lug 76 to allow upward and downward movement of lug 76 within window 78, as discussed further below, thereby allowing relative movement of the link lever 68 with the release lever 36 between decoupled and coupled positions.

Figure 4A:
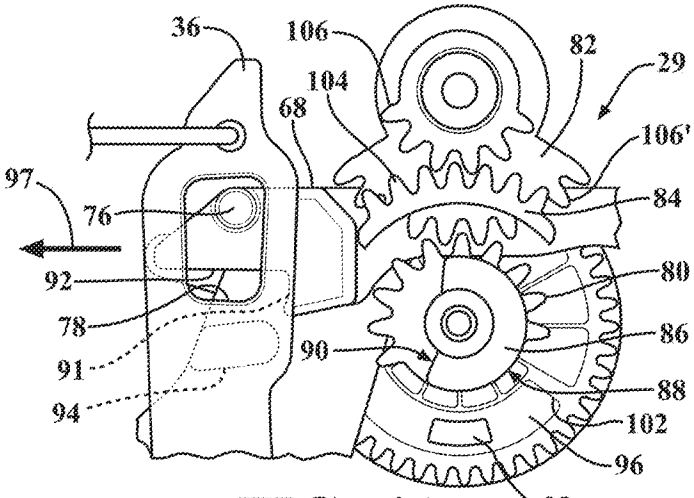
FIG. 4A is a partial view of the mechanical override system of FIG. 3 illustrating with some components shown in transparency for clarity purposes only.
Figure 4B:
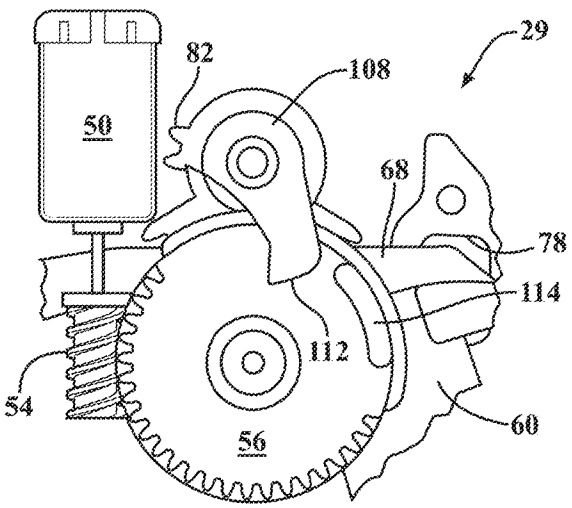
FIG. 4B is a partial backside view of the mechanical override system of FIG. 3.
Figure 4:
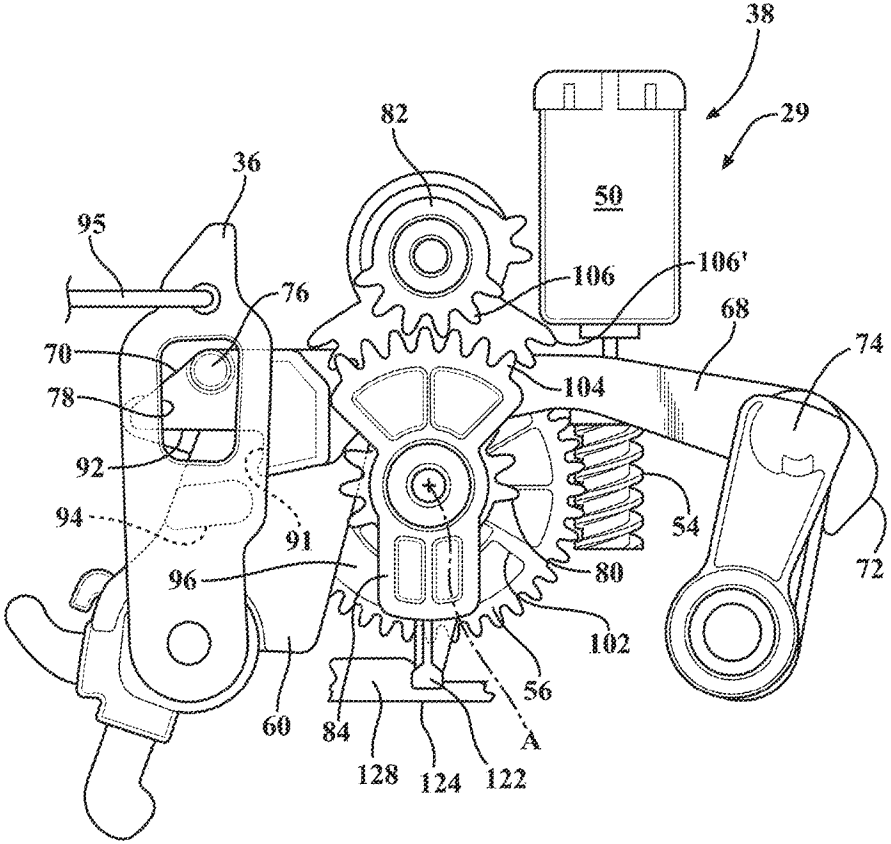
FIG. 4 is an elevation view of the mechanical override system of FIG. 3 shown in a neutral, mechanically disengaged position.

Movement of the link lever 68 between its disengaged/decoupled and engaged/coupled states is facilitated by selective movement of a first gear 80, a second gear 82 and a third gear 84 relative to one another. The third gear 84 is configured for driven engagement with the power release gear 56, such that third gear 84 is rotatably driven in response to rotation of power release gear 56; the second gear 82 is configured to be rotatably driven in response to rotation of third gear 84, and the first gear 80 is configured to be rotatably driven in response to rotation of second gear 82. A cam lobe 86 is fixed to the first gear 80 for conjoint rotation therewith, with cam lobe 86 having an irregularly shaped, eccentric surface relative to the axis A about which power release gear 56, first gear 80 and third gear 84 rotate. Cam lobe 86 is maintained in abutment with link lever 68 for selective movement of link lever 68 between the disengaged/decoupled and engaged/coupled states. The irregular surface of cam lobe 86 can include a relatively raised circular or generally circular surface 88 having a radius R that is maintained in engagement with link lever 68 to maintain the link lever 68 in its disengaged/decoupled state and a reduced radius r' (FIG. 3E) (relative to circular surface 88), shown by way of example and without limitation as a generally flat surface 90, brought into abutment with the link lever 68 to allow link lever 68 to move to its engaged/coupled state. When link lever 68 is in its disengaged/decoupled state, a drive shoulder 91, extending outwardly from a recessed notch 92 in link lever 68, is spaced out from potential contact with a drive lug or knob, also referred to as drive protrusion 94 fixed to actuator output lever 60. Thus, translation of link lever 68 in the direction of arrow 97 (FIGS. 3 and 4A) in response to mechanical actuation of inside/outside door handles 24, 26, such as via movement in direction 93 of a Bowden cable 95, while link lever 68 is in the disengaged/decoupled state does not allow drive shoulder 91 to engage drive protrusion 94 during mechanical actuation of inside/outside door handles 24, 26, and thus, pawl 32 is maintained in the ratchet holding position, thereby maintaining swing door 12 in the closed position. When link lever 68 is selectively moved into its engaged/coupled state (FIGS. 8-9) via command by ECU 64, such as when child lock is disengaged or during and upon a crash condition, as discussed above, the drive shoulder 91 is lowered, as viewed in the Figures, and is brought into an aligned, confronting position relative to drive protrusion 94 such that translation of link lever 68 in the direction of arrow 97, in response to mechanical actuation of either the inside or outside door handles 24, 26 while link lever 68 is in the engaged/coupled state, causes drive shoulder 91 to engage drive protrusion 94, thereby rotatably driving actuator output lever 60 and driving pawl 32 to its ratchet releasing position, thus allowing swing door 12 to be opened.

Figure 3G:
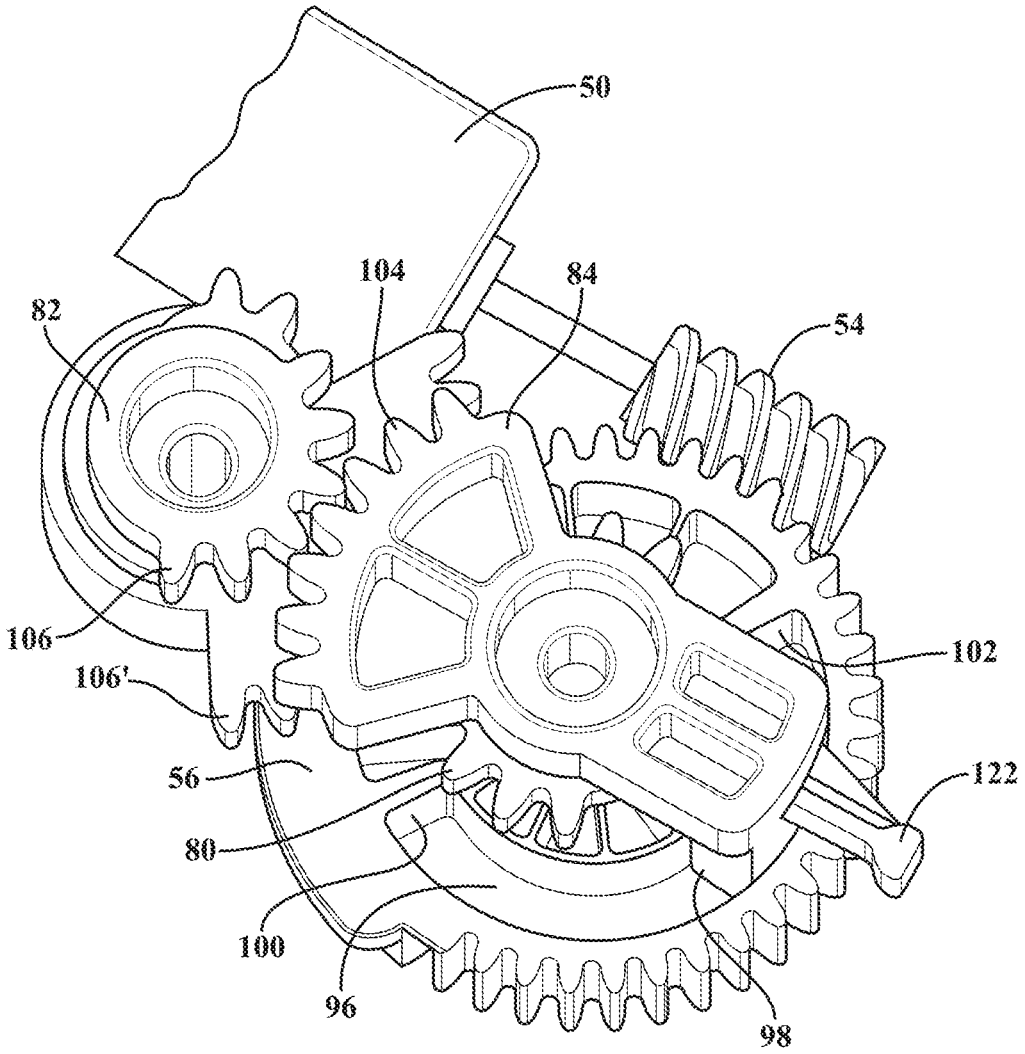
Figure 4C:
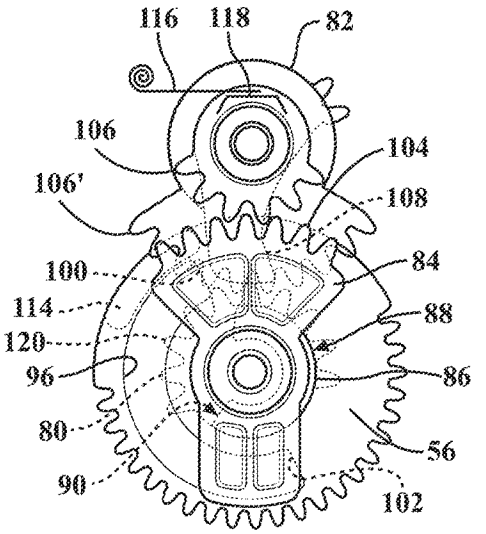
FIG. 4C is an elevation view of the mechanical override system as shown in FIG. 4.
Figure 5C:
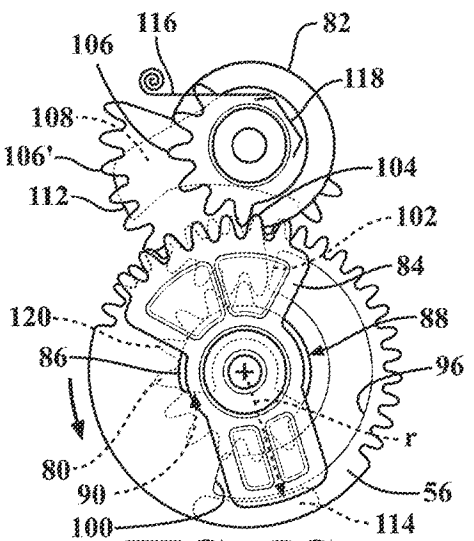
FIGS. 5-5C are similar views to FIGS. 4-4C, respectively, with the mechanical override system shown in a normally powered release, mechanically disengaged position.
Figure 5A:
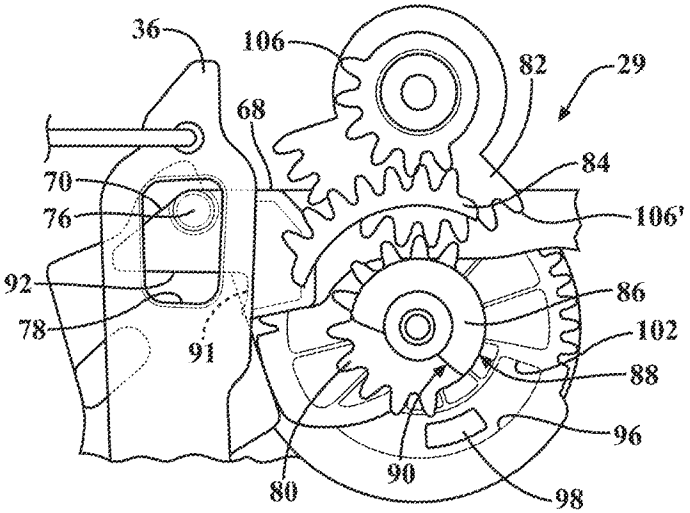
Figure 5B:
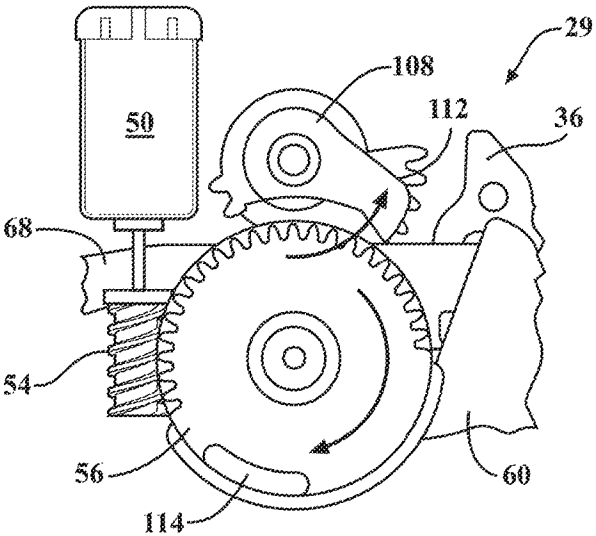
Figure 5:
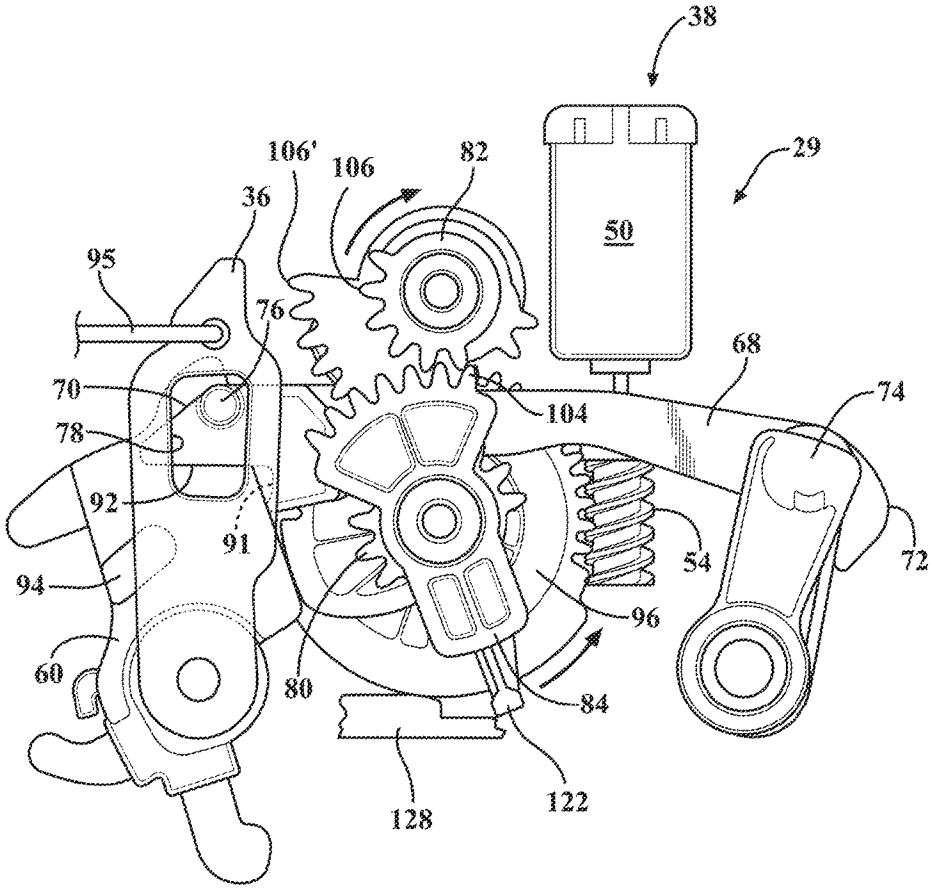

The power release gear 56 has an arcuate slot 96 configured for sliding receipt of a protrusion, also referred to as drive lug 98, extending outwardly in an axial direction relative to the axis A about which power release gear 56 rotates in fixed relation from the third gear 84. As such, as the power release gear 56 is rotatably driven by power release worm gear 54, drive lug 98 is free to slide within slot 96, thereby allowing third gear 84 to remain stationary. Slot 96 terminates at opposite ends, also referred to as first and second shoulders 100, 102, respectively, as best shown in FIG. 3G. As power release gear 56 is rotated from a start position, also referred to as neutral position (FIG. 4-4C), in a first, counterclockwise direction to a unlatched, also referred to as release, position, as viewed in FIGS. 5-5C, drive lug 98 slides within slot 96 until the first shoulder 100 of power release gear 56 engages drive lug 98 of third gear 84 and causes third gear 84 to rotate with power release gear 56 in the counterclockwise direction to the release position. As the third gear 84 is rotated, gear teeth 104 of third gear 84 meshed with gear teeth 106 of second gear 82 cause the second gear 82 to rotate in a clockwise direction, as shown in FIGS. 5 and 5C. At the same time, a double pull sector 108, which is coupled to second gear 82 for selective rotation therewith with a spring member 110 (FIG. 3D) disposed therebetween to allow selective relative rotation therebetween, is caused to rotate with the second gear 82. As shown in FIGS. 5B and 5C, a free end 112 of the double pull sector 108 is rotated outwardly away from the rotation axis A of power release gear 56, and is shown as being rotated outwardly beyond a radius (r) of an outer surface of a cam member, also referred to as stop member 114, that is fixed to power release gear 56 and extends laterally outwardly therefrom along the direction of axis A, and accordingly, double pull sector 108, while in this position, is out of a swing path of stop member 114. While in the release position illustrated in FIG. 5-5C, the pawl 32 is driven to the ratchet releasing position, thereby allowing swing door 12 to be opened.

Figure 6C:
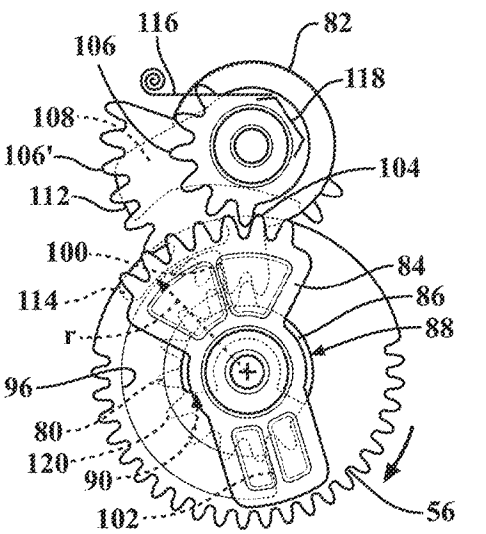
FIGS. 6-6C are similar views to FIGS. 5-5C, respectively.
Figure 6D:
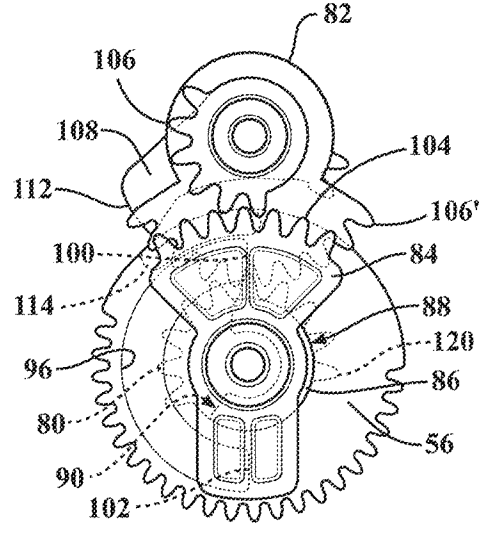
FIG. 6D illustrates a further view with the mechanical override system shown in a normally powered, partially reset, mechanically disengaged position.
Figure 6A:
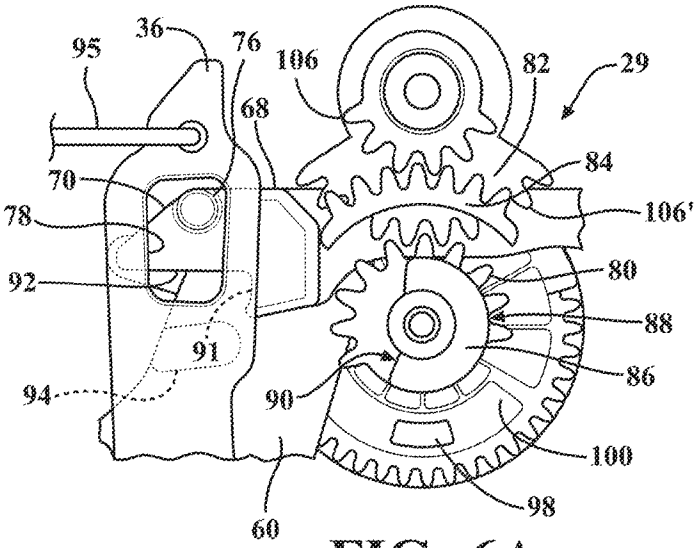
Figure 6B:
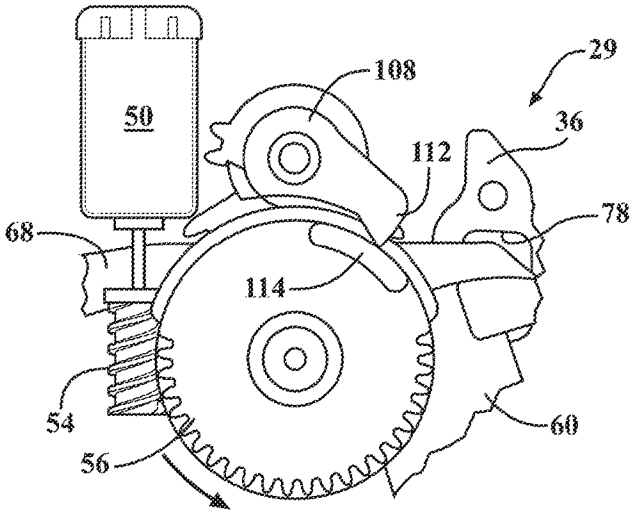
Figure 6:
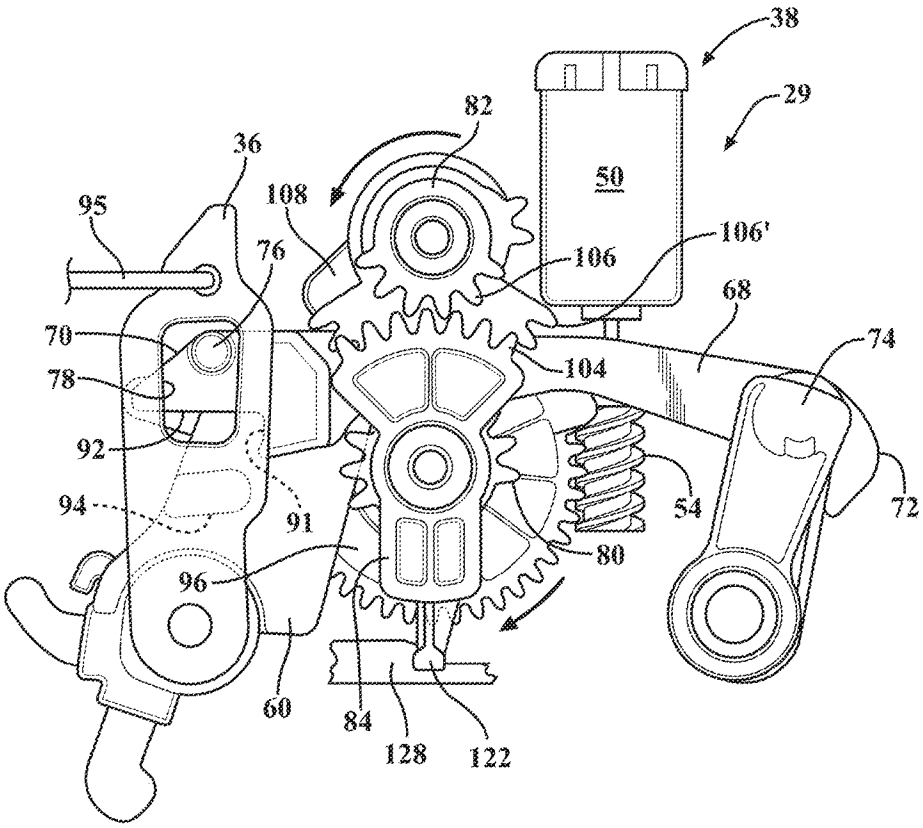

Upon the vehicle door 12 being opened, the power release motor 50 is commanded via ECU 64 to drive power release worm gear 54 such that it drives power release gear 56 in a second, clockwise direction, as viewed in FIGS. 6 and 6C. As power release gear 56 rotates clockwise, the third gear 84 and second gear 82, along with double pull sector 108, remain temporarily positioned in the release position of FIGS. 5, 5B and 5C, both as a result of the drive lug 98 of third gear 84 sliding freely in slot 96 of power release gear 56, and as a result of a spring member 116 (shown schematically in FIGS. 4C, 5C and 6C) being biased into engagement with a first holding surface, also referred to as first detent 118 on a hub of second gear 82. Accordingly, second gear 82 and double pull sector 108 remain static until the drive lug 98 of third gear 84 engages the second shoulder 102 of slot 96 in power release gear 56.

Figure 7C:
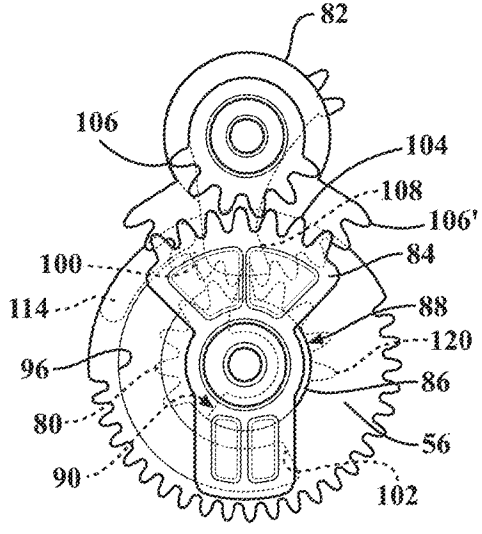
FIGS. 7-7C are similar views to FIGS. 6-6C, respectively, with the mechanical override system shown in a normally powered, fully reset, mechanically disengaged position.
Figure 7A:
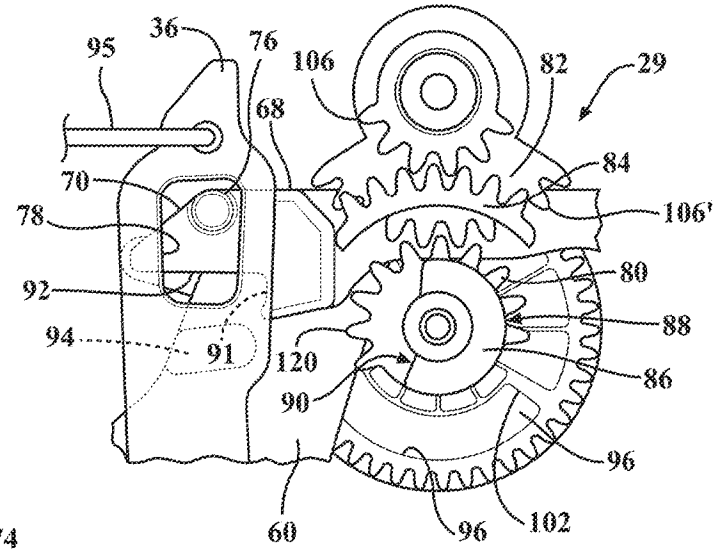
Figure 7B:
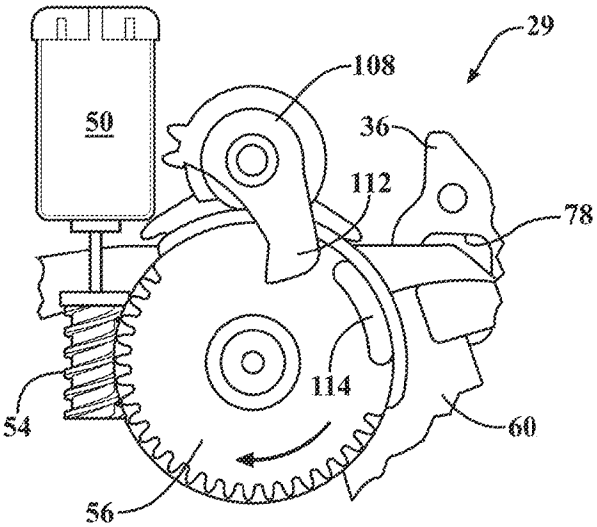
Figure 7:
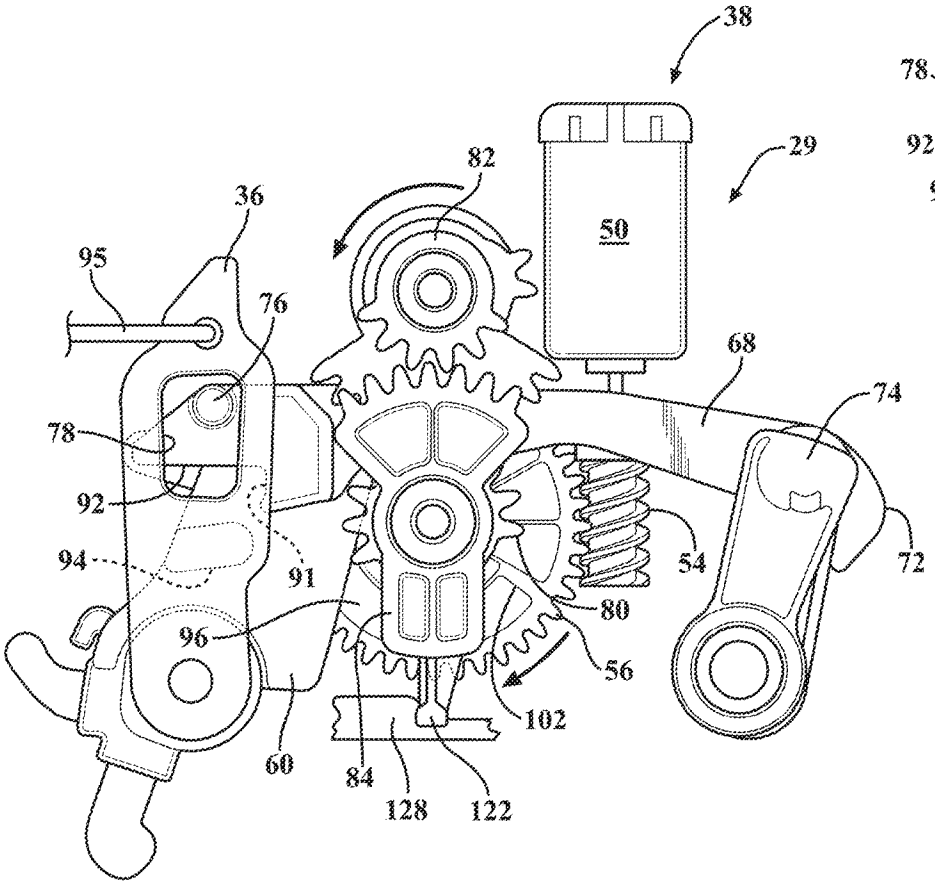

Upon drive lug 98 of third gear 84 being engaged by the second shoulder 102 of slot 96 in power release gear 56, continued rotation of power release gear 56 drives second gear 82 back toward the neutral position (FIGS. 6 and 6D), overcoming the holding force of a spring member 116 biased against the first detent 118 on a hub of second gear 82; however, double pull sector 108 remains temporarily behind in its radially outward position due to being engaged with a stop member 114 of power release gear 56 (FIGS. 6B and 6D). Continued movement of power release gear 56 and second gear 82 causes the spring member 110 between double pull sector 108 and second gear 82 to become loaded. Then, upon continued rotation of power release gear 56 e.g. as moved clockwise in FIG. 7B as a result of a spring (not shown) having been loaded during the counterclockwise rotation of the power release gear 56, stop member 114 moves out from blocking engagement with free end 112 of double pull sector 108, whereupon double pull sector 108 returns to its radially inwardly extending position under the bias of spring member 110. Then, power release gear 56, first gear 80, second gear 82 and third gear 84 return to the reset, neutral position, as shown in FIGS. 7-7C.

Figure 8C:
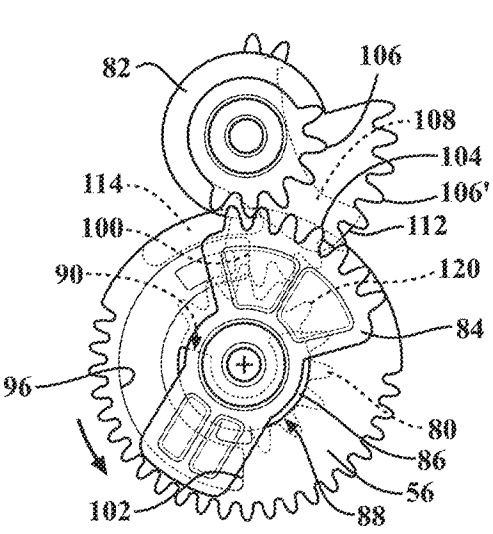
FIGS. 8-8C are similar views to FIGS. 4-4C, respectively, with the mechanical override system shown in a powered, mechanically engaged position.
Figure 8A:
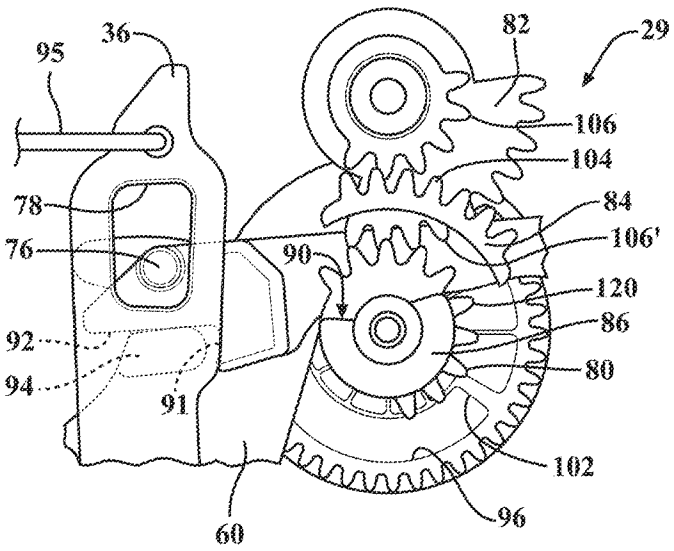
Figure 8B:
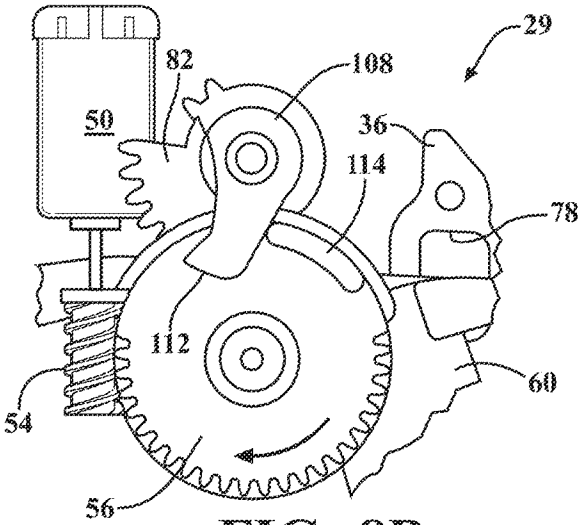
Figure 8:
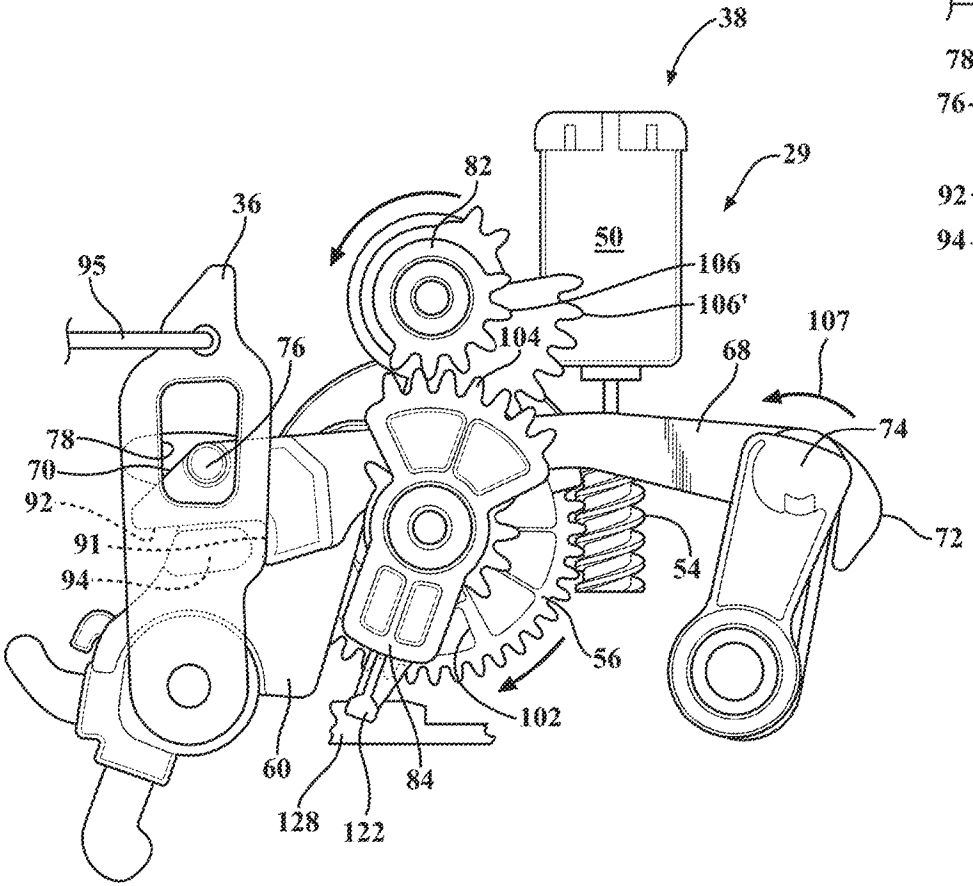
Figure 9:
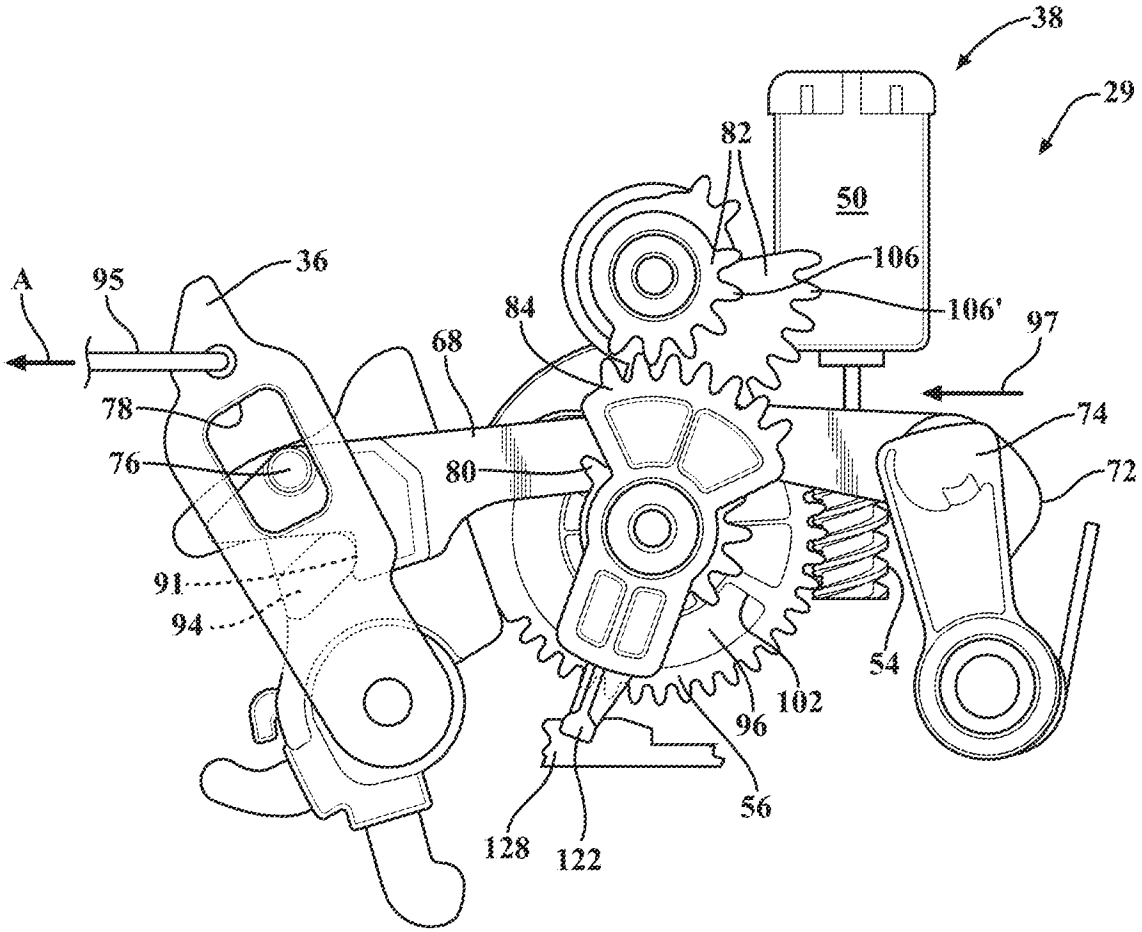
FIG. 9 is a view similar to FIG. 4 of the mechanical override system of FIG. 3 shown in a mechanically actuated, mechanically engaged position.

In a crash condition, wherein the following actuation is automated in response to crash detection sensors, such as proximity sensors 66 and the like, or when child lock is selectively disengaged, power release gear 56 is rotatably driven in the second, clockwise direction via command from ECU 64 to power release motor 50, as viewed in FIGS. 8 and 8C, whereupon stop member 114 on power release gear 56 confronts and drives double pull sector 108 in a clockwise direction, as viewed in FIG. 8B. Rotation of double pull sector 108 drives second gear 82 in conjoint clockwise direction of rotation, whereupon gear teeth 106' of second gear 106 drive gear teeth 120 of first gear 80 in a counterclockwise direction, as viewed in FIG. 8A. In turn, cam lobe 86, fixed to the first gear 80, is driven with first gear 80, with the enlarged radius R, semicircular surface 88 of cam lobe 86 being rotated out of engagement from link lever 68 and with reduced radius r', generally flat surface 90 being rotated into abutment with the link lever 68 to move (lower) link lever 68 from its disengaged/decoupled state to its engaged/coupled state, or to allow link lever 68 to be moved into abutment with flat surface 90 as a result of a biasing force 107 acting upon the link lever 68. When link lever 68 is in its engaged/coupled state, drive shoulder 91 is aligned for confronting abutment with drive protrusion 94 fixed to actuator output lever 60. As such, translation of link lever 68 via engagement of lug 76 by release lever 36, in response to release lever 36 being mechanically actuated under a pulling bias of Bowden cable 95 in direction of arrow A (FIG. 9) via mechanical actuation of inside/outside door handles 24, 26, causes drive shoulder 91 of link lever 68, while in its engaged/coupled state, to engage drive protrusion 94 (FIG. 9), and thus, pawl 32 is driven from the ratchet holding position to the ratchet releasing position. Accordingly, swing door 12 is able to be opened via mechanical operation of inside and outside door handles 24, 26. Then, the next release operation performed as described above with regard to FIGS. 5-5B causes mechanical override system 29 to be reset, such that link lever 68 is returned to its disengaged state.

As such, latch assembly 10 is configured to be solely power actuated, if desired, while in a normal use state, wherein mechanical movement of inside and outside door handles 24, 26 is inoperable to effect unlatching actuation of the latch assembly 10. Further, latch assembly 10 is configured to be mechanically actuated while a child lock is disengaged and/or upon experiencing a crash condition, wherein mechanical movement of inside door handle 24 in the former embodiment, and the outside door handle 26 in the latter embodiment, are operable to effect unlatching actuation of the latch assembly 10. In these embodiments, only one of the handles 24, 26 is connected to the release lever 36 via the Bowden cable 95. It is recognized, in accordance with another embodiment, that inside door handle 24 and outside door handle 26 may be both operatively connected to the release lever 36 via a splitter mechanism (not shown) such that a movement of either handles 24, 26 may be operative to effect unlatching actuation of the latch assembly 10.

To facilitate mechanical actuation of override system 29, such as in the absence of power to motor 50, third gear 84 can be formed having a mechanically actuatable, elongate actuation lever 122, shown as extending radially outward from drive lug 98. Further, a lock knob 124 can be configured for receipt in the fishmouth 19 of the vehicle door 12, wherein the lock knob 124 has a receptacle 126 configured for receipt of a tool, such as a vehicle key, for selective movement of a drive lever 128 of the lock knob 124 into engagement with the actuation lever 122 to move the link lever 68 to the coupled position with the actuator output lever 60, as discussed above, to move the release mechanism 29 to the engaged position. The lock knob 124 is shown as having a generally cylindrical body 130 with the drive lever 128 extending radially outwardly therefrom, such that upon rotation of the cylindrical body via vehicle key, drive lever 128 is caused to pivot into driving engagement with actuation lever 122, thereby rotatably driving third gear 56 in the second direction to bring link lever 68 to the coupled position with the actuator output lever 60.

Figure 10:
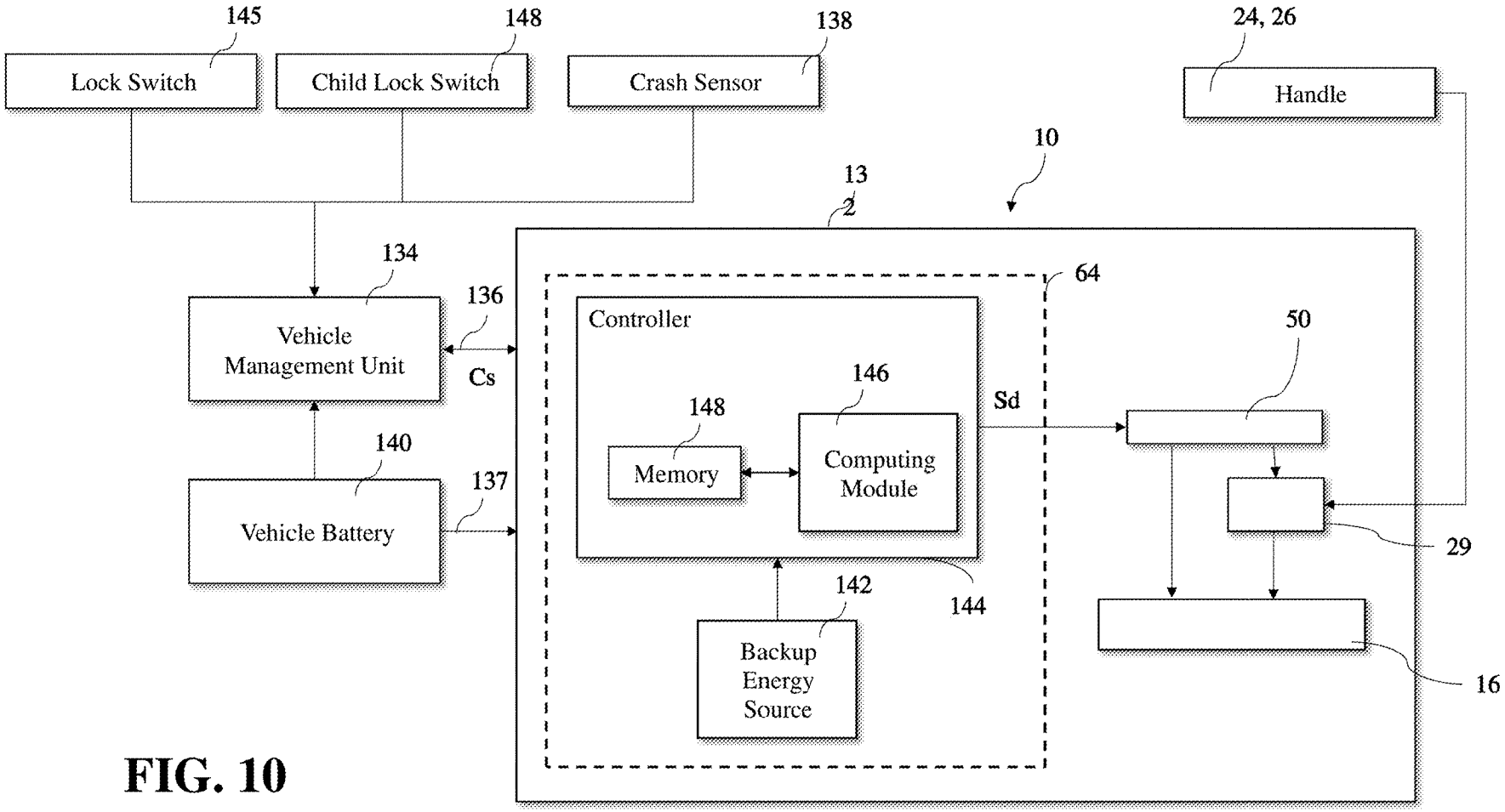
FIG. 10 is a block diagram of an electronic control circuit of the power latch assembly of FIG. 1, in accordance with an illustrative embodiment.

Now referring to FIG. 10, the power latch assembly 10 includes the latch electronic control unit (ECU) 64, also referred to as the controller, for example including, as discussed in detail hereinafter, a microcontroller or other known computing unit, which, in a possible embodiment, is conveniently embedded and arranged in a same latch housing or case (shown schematically as 132) together with an power release actuator system 38, thus providing an integrated compact and easy-to-assemble unit. The electronic control unit (ECU) 64 is coupled to the power release actuator system 38 and provides to the prime mover, for example the power release motor 50, suitable driving signals Sd. The electronic control unit (ECU) 64 is electrically coupled to a vehicle management unit 134, which is configured to control general operation of the motor vehicle 14, via an electrical connection element 136, for example a data bus, so as to exchange signals, data, commands and/or information. The vehicle management unit 134 is also coupled to crash sensors 138, for example accelerometer or force sensors, which provide signals, for example acceleration or force signals, which indicate the presence of an emergency situation, such as a crash. Other sensors may be provided to detect the state of the vehicle 14, such as a main battery disconnect sensor (not shown), which may be integrated into vehicle management unit 134. Conveniently, the electronic control unit (ECU) 64 also receives feedback information about the latch actuation from position sensors (not shown), such as Hall sensors, configured to detect the operating position, for example of the ratchet 30 and/or pawl 32; and also receives (directly and/or indirectly via the vehicle management unit 134) information about the actuation of the vehicle (external and/or internal) handles 24, 26 and/or from handle sensors 63, 62, which detect user activation of the internal and/or external handles 24, 26 of the door 12 of the motor vehicle 14. The electronic control unit (ECU) 64 is also coupled to the main power source 140 of the motor vehicle 14, so as to receive the battery voltage Vbatt 137; the electronic control unit (ECU) 64 is able to check if the value of the battery voltage Vbatt decreases below a predetermined threshold value, for example which may indicate a low power condition, a battery disconnect condition, which may in response require the power latch assembly 10 to be transitioned from a normal mode of operation whereby the power release actuator system 38 is electronically controlled for controlling powered actuation of the latch release assembly 10 without the requirement or enablement of a manual activation of external and/or internal handles 24, 26 for controlling the manual actuation of the latch release assembly 10. According to an aspect of the present disclosure, the electronic control unit (ECU) 64 includes an embedded and integrated backup energy source 142, which is configured to supply electrical energy to the prime mover, for example the power release motor 50 and to the same electronic control unit (ECU) 64, in case of failure or interruption of the main power source 140 of the motor vehicle 14. The electronic control unit (ECU) 64 is able to check if the value of the backup energy source voltage Vbackup decreases below a predetermined threshold value. This backup energy source 142 is usually kept in a charged state during normal operation, by the main power source 140, so as to be readily available as soon as the need arises, for example in case of a crash or loss of the main vehicle battery 140. In more details, electronic control unit (ECU) 64 includes a control unit 144, for example provided with a microcontroller, microprocessor or analogous computing module 146, coupled to the backup energy source 142 and the power release motor 50 (providing thereto the driving signal Sd), to control the operation of the power release motor 50. The control unit 144 has an embedded memory 148, for example a non-volatile random access memory, coupled to the computing module 146, storing suitable programs and computer instructions (for example in the form of a firmware). It is recognized that the control unit 144 could alternatively comprise a logical circuit of discrete components to carry out the functions of the computing module 146 and memory 148. The electronic control unit (ECU) 64 is configured to control the latch release assembly 10 for controlling actuation of the door 12, based on signals detected by the handle sensors 63, 62, which are indicative for example of the user intention to power release and open the door 12, and based on signals received from the vehicle management unit 134, which are indicative for example of a correct authentication of the user carrying suitable authentication means (such as in a key fob 28), in a normal mode of operation, and the electronic control unit (ECU) 64 is configured to control the latch release assembly 10 for controlling actuation of the door 12, based a manual actuation by one or both handles 24, 26 based on signals received from the vehicle management unit 134, which are indicative for example of a state of the vehicle such as a crash condition, an emergency condition, a low or disconnected power supply condition whereby the power release operation of the latch release assembly 10 is not desired or possible. Furthermore, the electronic control unit (ECU) 64 is configured to control the latch release assembly 10 for controlling a manual actuation of the door 12, based on signals indicating a desired operating condition of the latch release assembly 10, which may include for example a double lock operating state of the latch release assembly 10 controlled by activation of a double lock or lock switch 145 for example provided on the FOB 28, a child lock disabled operating state controlled by activation of a child lock switch 148 whereby a manual activation of the inside door handle 24 will cause the manual activation of the latch release assembly 10.

Figure 11A:
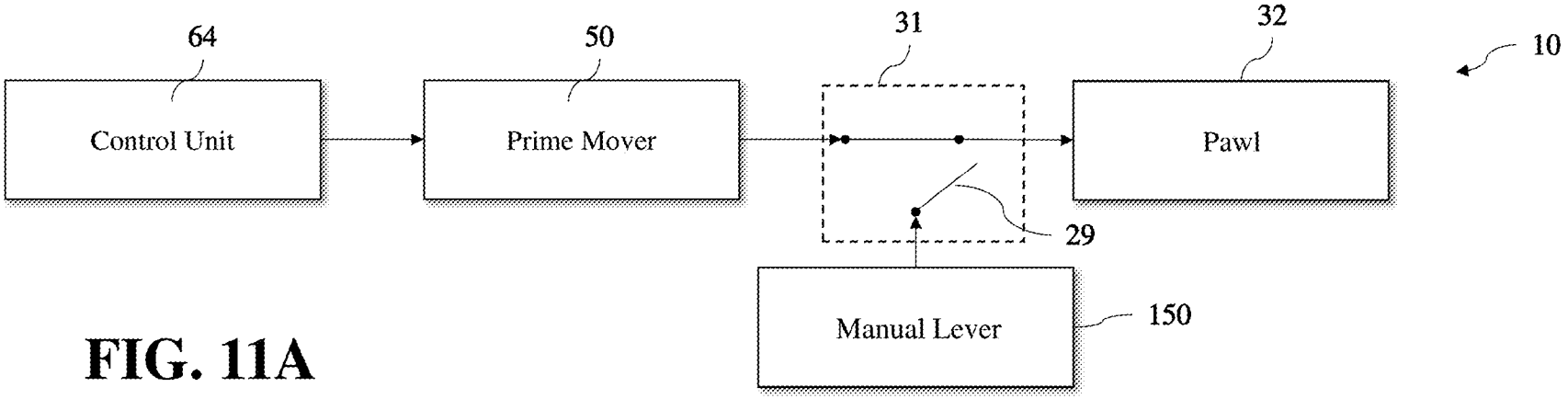
FIGS. 11A and 11B are system diagram of the power latch assembly of FIG. 1 operating in a normal mode and a manual mode respectively, in accordance with an illustrative embodiment.
Figure 11B:
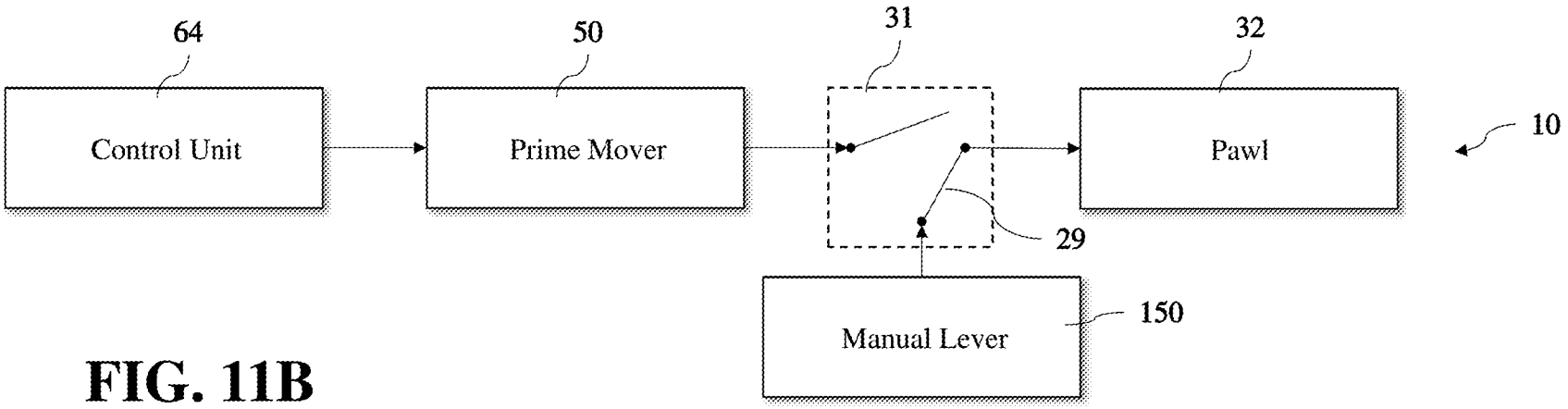

Now referring to FIG. 11A, in accordance with an illustrative embodiment, there is illustrated a system diagram of a power latch assembly 10 for a vehicle door 12 including the ratchet 30 configured for movement between a striker capture position and a striker release position and being biased toward the striker release position, a pawl 32 configured for movement between a ratchet holding position whereat the pawl maintains the ratchet 30 in the striker capture position and a ratchet releasing position whereat the pawl 32 releases the ratchet 30 for movement of the ratchet to the striker release position, an override release mechanism 29 forming part of a bypass assembly 31 configured for mechanical actuation by at least one of an inside door handle 24 and an outside door handle 26 generically referred to as a manually operated lever 150 and which may include a key cylinder as an example, and being moveable between a disengaged state as illustrated in FIG. 11A, whereat the override release mechanism 29 is disengaged from operable communication with the pawl 32 whereby an activation of the manual lever 150 will not cause actuation of the pawl 32 while bypass assembly 31 allows the motor 50 to be operatively coupled to the pawl 32, and an engaged state as illustrated in FIG. 11B, whereat the override release mechanism 29 has transitioned into operable communication with the pawl 32 and bypass assembly 31 operatively decouples the motor 50 from the pawl 32. When in the disengaged state of FIG. 11A, latch assembly 10 is in a normal operating mode and a control of the prime mover 50 will cause a power release of the pawl 32 as described herein above. A prime mover 50 is operatively coupled to the pawl 32 and is configured to move the pawl 32 from the ratchet holding position to the ratchet releasing position and to maintain the override release mechanism 29 in the disengaged position during the normal operation of the power latch assembly, and to selectively move the override release mechanism 29 to the engaged position. A controller 64 is provided and configured to control activation of the prime mover 50 in response to determining an operating mode of the power latch assembly 10, for example in response to determining a crash condition, an emergency condition, an insufficient power supply condition or either the main vehicle battery or backup power supply, a double lock condition, a child lock condition, and the like without limitation. When in the engaged state of FIG. 11B, latch assembly 10 is in a manual operating mode and a control of the prime mover 50 may not cause a power release of the pawl 32 as described herein above whereas a manual operation of the handle 24, 26 may cause a manual movement of the pawl 32. It is recognized that during a manual operating mode of the latch assembly 10, latch assembly 10 may be configured to allow a power release of the pawl 32.

Figure 12:
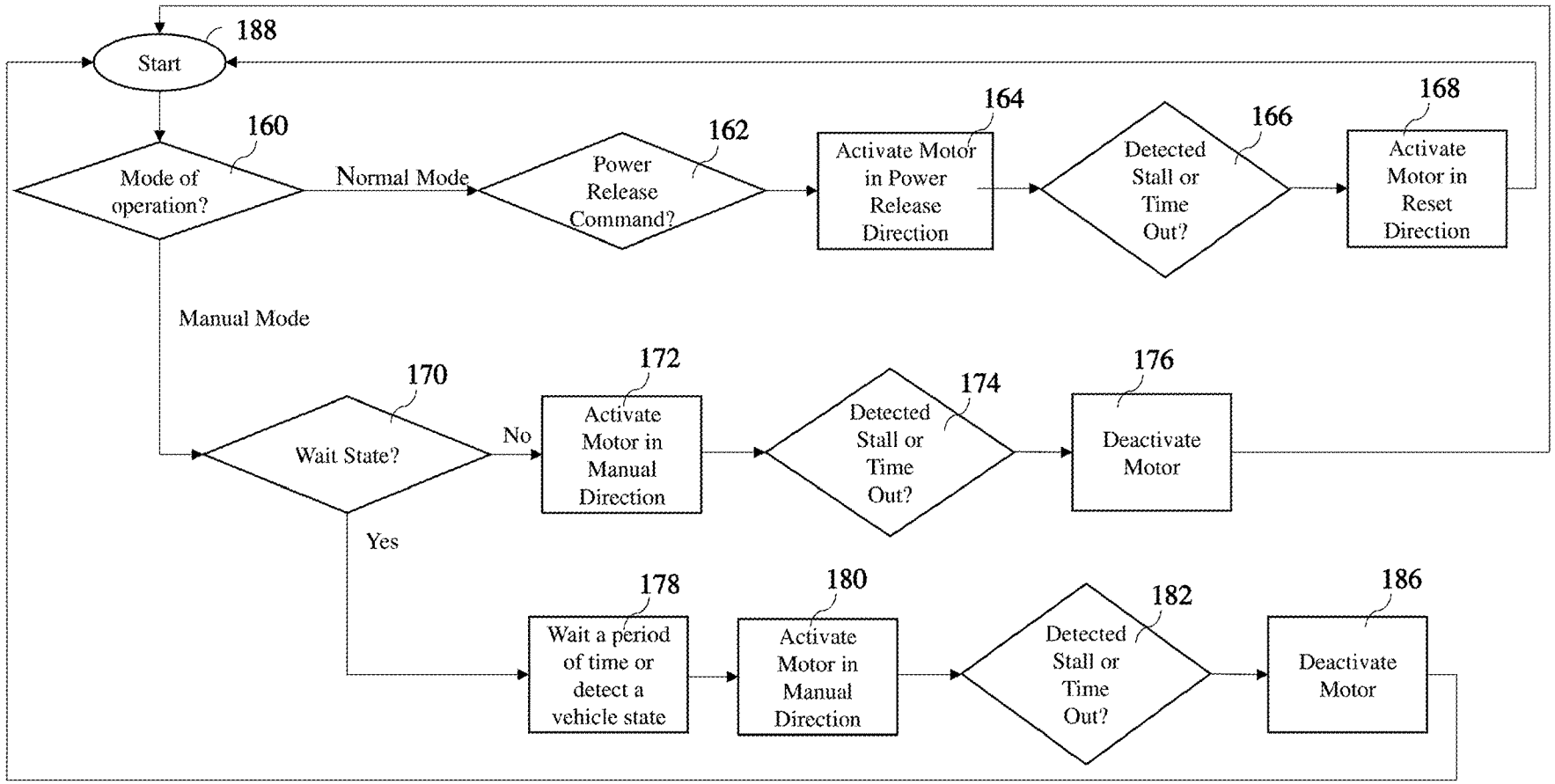
FIG. 12 is a flow chart relating to a mode-management procedure implemented in the electronic control circuit of FIG. 10, in accordance with an illustrative embodiment.

Now referring to FIG. 12, according to an aspect of the present disclosure, the electronic control unit (ECU) 64 is also configured to manage at step 160 the operating mode of the power latch assembly 10 and to implement, locally to the power latch assembly 10, a suitable control algorithm to control the power latch assembly 10, and for example without external intervention by the vehicle management unit 134. The electronic control unit (ECU) 64 may determine a mode of operation, such as for example a normal mode for a power release of the power latch assembly 10 whereby a manual activation of the power latch assembly 10 is not possible, and a manual mode for a manual activation of the power latch assembly 10, whereby a power release of the power latch assembly 10 may or may not be possible. When the electronic control unit (ECU) 64 determines the power latch assembly 10 may operate in a normal mode, electronic control unit (ECU) 64 is responsive at step 162 to a power release command received from the FOB 28, vehicle management unit 134, or one of the sensors 62, 63 to generate and transmit driving signal Sd to activate motor 50 at step 164 in order to cause the pawl 32 to move. At step 166, electronic control unit (ECU) 64 may detect a stall of the motor 50, due to a current spike or as a result of a hall sensor reading or switch activation sensing the position of the power release gear 56, or as a result of a time out period indicating the completion of a power release, for example as illustrated in FIG. 5. At step 168, electronic control unit (ECU) 64 may subsequently generate and transmit driving signal Sd to activate motor 50 in a reset direction, such as a direction opposite the direction of the motor 50 as driving in step 164, or the motor 50 may be further activated in the same direction as driven in step 166. When the electronic control unit (ECU) 64 determines the power latch assembly 10 may operate in a manual mode, electronic control unit (ECU) 64 determines at step 170 if the motor 50 is to be activated immediately, for example when the electronic control unit (ECU) 64 receives a child lock or double lock state disable command, or a power release operation has been determined by the electronic control unit 64 as having failed for example in response to a sensor detecting that pawl 32 has not moved subsequent a powered operation for example, the electronic control unit (ECU) 64 determines vehicle main battery 140 or backup energy supply 142 has drained to a predetermined level, or other malfunction of the release mechanism 18, or if it is required to postpone the activation of motor 50. If at step 170 electronic control unit (ECU) 64 determines the motor 50 is to be activated immediately, at step 172 the electronic control unit (ECU) 64 may subsequently generate and transmit driving signal Sd to activate motor 50 in a reset direction to transition the latch assembly 10 to a state as illustrated in FIG. 8. At step 176 the electronic control unit (ECU) 64 may deactivate motor 50 in response to detecting a stall or end of travel position, or the activation of a switch sensing the position of the power release gear 56 or a time out of a preset period of time at step 174 to maintain the latch assembly 10 in the state as illustrated in FIG. 8. If the electronic control unit (ECU) 64 determines at step 170 based on the type of manual mode, such as based on the crash event or an emergency event, the electronic control unit (ECU) 64 may postpone the activation of motor 50 and at step 178 wait for a period of time after a crash event is detected, or based on the state of the vehicle as detected by an accelerometer indicating the end of a crash event. At step 180 the electronic control unit (ECU) 64 may subsequently generate and transmit driving signal Sd to activate motor 50 in a reset direction to transition the latch assembly 10 to a state as illustrated in FIG. 8. At step 182 the electronic control unit (ECU) 64 may detect a stall or end of travel position of the motor 50 causing a deactivation of motor 50 at step 184 in response to detecting a position of power release gear 56 or a time out of a preset period of time to maintain the latch assembly 10 in the state as illustrated in FIG. 8 whereby the override release mechanism 29 is engaged. Electronic control unit (ECU) 64 may at step 188 return to a standby state whereby the override release mechanism 29 returns to a disengaged state as a result of a bias for example acting on the override release mechanism 29, for example as acting indirectly on power release gear 56.

Figure 13:
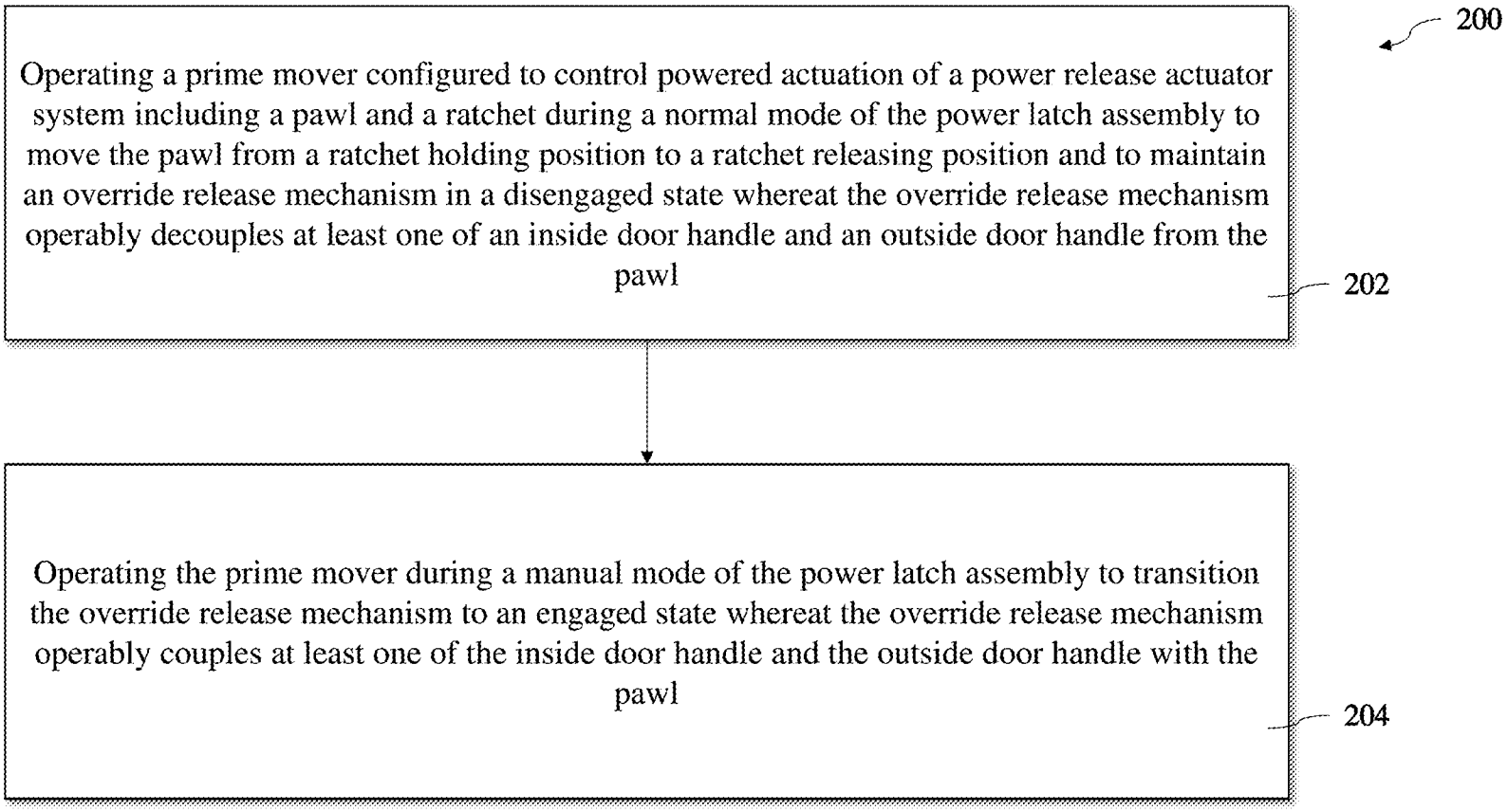
FIG. 13 is a method of operating the power latch assembly of FIG. 1, in accordance with an illustrative embodiment.

Now referring to FIG. 13, there is illustrated a method of operating the power latch assembly 10 for the vehicle door 12, the method 200 illustratively included the steps of operating a prime mover configured to control powered actuation of a power release actuator system including a pawl and a ratchet during a normal mode of the power latch assembly to move the pawl from a ratchet holding position to a ratchet releasing position and to maintain an override release mechanism in a disengaged state whereat the override release mechanism operably decouples at least one of an inside door handle and an outside door handle from the pawl 202, and operating the prime mover during a manual mode of the power latch assembly to transition the override release mechanism to an engaged state whereat the override release mechanism operably couples at least one of the inside door handle and the outside door handle with the pawl 204.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power latch assembly for a vehicle door, comprising:

a ratchet configured for movement between a striker capture position and a striker release position and being biased toward said striker release position;

a pawl configured for movement between a ratchet holding position whereat said pawl maintains said ratchet in said striker capture position and a ratchet releasing position whereat said pawl releases said ratchet for movement of said ratchet to said striker release position;

a pawl release lever configured to selectively move said pawl from said ratchet holding position to said ratchet releasing position;

an override release mechanism configured for mechanical actuation by at least one of an inside door handle and an outside door handle and being moveable between a disengaged position, whereat said override release mechanism is disengaged from operable communication with said pawl release lever, and an engaged position, whereat said override release mechanism is engaged in operable communication with said pawl release lever;

a power release actuator system configured to control powered actuation of said pawl release lever to move said pawl from said ratchet holding position to said ratchet releasing position and to maintain said override release mechanism in said disengaged position during normal operation of the power latch assembly and to selectively move said override release mechanism to said engaged position, wherein said power release actuator system includes a motor and a drive gear driven by said motor, said drive gear being in meshed engagement with a power release gear having a release cam fixed thereto, and further including an actuator output lever configured for movement in response to engagement with said release cam as said power release gear is rotated via driven movement of said drive gear by said motor, wherein said actuator output lever is configured to move said pawl release lever and cause said pawl to move between said ratchet holding and releasing positions, wherein said override release mechanism includes a release lever operably connected with the outside door handle and a link lever configured for movement in response to movement of said release lever, said link lever being moveable to a decoupled position relative to said actuator output lever to maintain said override release mechanism in said disengaged position and to a coupled position relative to said actuator output lever to move said override release mechanism to said engaged position; and further including a cam lobe configured for conjoint rotation with said power release gear, said cam lobe maintaining said link lever in said decoupled position relative to said actuator output lever to maintain said override release mechanism in said disengaged position during normal operation of said power latch assembly, said cam lobe moving said link lever to said coupled position relative to said actuator output lever to move said override release mechanism to said engaged position in a selective and/or non-normal condition, wherein said power release gear rotates in a first direction from a neutral position to an unlatched position to cause said actuator output lever to move said pawl release lever into engagement with said pawl to move said pawl to said ratchet releasing position, whereupon said power release gear rotates in a second direction opposite said first direction from said unlatched position to said neutral position to allow said pawl to return to said ratchet holding position, wherein said power release gear rotates from said neutral position in said second direction to cause said cam lobe to move said link lever to said coupled position with said actuator output lever to move said override release mechanism to said engaged position.

2. The power latch assembly of claim 1, wherein said link lever is operably connected to said release lever for relative movement with said release lever between said decoupled position and said coupled position.

3. The power latch assembly of claim 1, further including a control unit in electrical communication with said motor, said control unit being configured in electrical communication with at least one sensor configured to detect a crash condition, said control unit automatically energizing said motor in response to a detected crash to move said power release gear from said neutral position in said second direction to cause said cam lobe to move said link lever to the coupled position with said actuator output lever to move said override release mechanism to said engaged position.

4. The power latch assembly of claim 3, wherein said control unit is configured to automatically energize said motor in response to a child lock being disengaged to move said power release gear from said neutral position in said second direction to cause said cam lobe to move said link lever to the coupled position with said actuator output lever to move said override release mechanism to said engaged position.

5. The power latch assembly of claim 1, further including a first gear configured in meshed engagement with a second gear, and a third gear configured for driven engagement with said power release gear and in meshed engagement with said second gear, said cam lobe being fixed to said first gear.

6. The power latch assembly of claim 5, wherein said third gear has a lost-motion connection with said power release gear.

7. A power latch assembly for a vehicle door, comprising:

a ratchet configured for movement between a striker capture position and a striker release position and being biased toward said striker release position;

a pawl configured for movement between a ratchet holding position whereat said pawl maintains said ratchet in said striker capture position and a ratchet releasing position whereat said pawl releases said ratchet for movement of said ratchet to said striker release position;

a pawl release lever configured to selectively move said pawl from said ratchet holding position to said ratchet releasing position;

an override release mechanism including a release lever configured for mechanical actuation by at least one of an inside door handle and an outside door handle and a link lever configured for movement in response to movement of said release lever, said link lever being moveable to a decoupled position to maintain said override release mechanism in a disengaged position, whereat said override release mechanism is displaced out of operable communication with said pawl release lever, and to a coupled position to move said override release mechanism to an engaged position, whereat said override release mechanism is configured in operable communication with said pawl release lever; and a power release actuator system configured to control powered actuation of said pawl release lever to move said pawl from said ratchet holding position to said ratchet releasing position and to maintain said override release mechanism in said disengaged position during normal operation of the power latch assembly and to selectively move said override release mechanism to said engaged position, wherein said power release actuator system includes a motor and a drive gear driven by said motor, said drive gear being in meshed engagement with a power release gear having a release cam fixed thereto, and further including an actuator output lever configured for movement in response to movement of said release cam as said power release gear is rotated via driven movement of said drive gear by said motor, wherein movement of said actuator output lever causes movement of said pawl release lever to move said pawl between said ratchet holding and releasing positions, said link lever being decoupled from said actuator output lever when in said decoupled position to maintain said override release mechanism in said disengaged position and being coupled with said actuator output lever when in said coupled position to move said override release mechanism to said engaged position.

8. The power latch assembly of claim 7, wherein said release lever has a window and said link lever has a lug disposed in said window, said window being sized to allow said lug to move therein for relative movement of said link lever with said release lever between said decoupled position and said coupled position.

9. The power latch assembly of claim 7, further including a cam lobe operably coupled to said power release gear, said cam lobe being configured to move said link lever between said decoupled position and said coupled position in response to movement of said power release gear.

10. The power latch assembly of claim 9, wherein said power release gear rotates in a first direction from a neutral position to an unlatched position to cause said actuator output lever to move said pawl release lever into engagement with said pawl to move said pawl to said ratchet releasing position, whereupon said power release gear rotates in a second direction opposite said first direction from said unlatched position to said neutral position to allow said pawl to return to said ratchet holding position, wherein said power release gear rotates from said neutral position in said second direction to cause said cam lobe to move said link lever to said coupled position with said actuator output lever to move said override release mechanism to said engaged position.

11. The power latch assembly of claim 10, further including a control unit in electrical communication with said motor, said control unit being configured in electrical communication with at least one sensor configured to detect a crash condition, said control unit automatically energizing said motor in response to a detected crash to move said power release gear from said neutral position in said second direction to cause said cam lobe to move said link lever to the coupled position with said actuator output lever to move said override release mechanism to said engaged position.

12. The power latch assembly of claim 10, further including a first gear configured in meshed engagement with a second gear, and a third gear configured for driven engagement with said power release gear and configured in meshed engagement with said second gear, said cam lobe being fixed to said first gear.

13. The power latch assembly of claim 12, wherein said third gear has an actuation lever and further including a lock knob configured for receipt in a fishmouth of the vehicle door, said lock knob being configured for receipt of a vehicle key for selective movement of the lock knob into engagement with the actuation lever to move said link lever to said coupled position with said actuator output lever to move said override release mechanism to said engaged position.

14. The power latch assembly of claim 12, wherein said third gear has a lost-motion connection with said power release gear allowing relative movement between said third gear and said power release gear.

15. A power latch assembly for a vehicle door, comprising:

a ratchet configured for movement between a striker capture position and a striker release position and being biased toward said striker release position;

a pawl configured for movement between a ratchet holding position whereat said pawl maintains said ratchet in said striker capture position and a ratchet releasing position whereat said pawl releases said ratchet for movement of said ratchet to said striker release position;

a pawl release lever configured to selectively move said pawl from said ratchet holding position to said ratchet releasing position;

an override release mechanism having a release lever configured for mechanical actuation by at least one of an inside door handle and an outside door handle and a link lever configured for movement in response to movement of said release lever, said link lever being moveable to a decoupled position to maintain said override release mechanism in a disengaged position, whereat said override release mechanism is displaced out of operable communication with said pawl release lever, and to a coupled position to move said override release mechanism to an engaged position, whereat said override release mechanism is configured in operable communication with said pawl release lever; and a power release actuator system includes a motor operably coupled with a power release gear having a release cam fixed thereto, and further including an actuator output lever configured for movement in response to movement of said release cam as said power release gear is operably rotated by said motor, wherein movement of said actuator output lever causes movement of said pawl release lever to move said pawl between said ratchet holding and releasing positions, said link lever being decoupled from said actuator output lever when in said decoupled position to maintain said override release mechanism in said disengaged position and being coupled with said actuator output lever when in said coupled position to move said override release mechanism to said engaged position.

16. The power latch assembly of claim 15, further including a first gear configured in meshed engagement with a second gear, and a third gear configured for driven engagement with said power release gear and in meshed engagement with said second gear, and a cam lobe being fixed to said first gear, said cam lobe maintaining said link lever in said decoupled position relative to said actuator output lever to maintain said override release mechanism in said disengaged position during normal operation of said power latch assembly, said cam lobe moving said link lever to said coupled position relative to said actuator output lever to move said override release mechanism to said engaged position in response to a selective and/or non-normal condition.

17. The power latch assembly of claim 16, wherein said third gear has a lost-motion connection with said power release gear.

18. The power latch assembly of claim 15, further including a cam lobe maintaining said link lever in said decoupled position relative to said actuator output lever to maintain said override release mechanism in said disengaged position during normal operation of said power latch assembly, said cam lobe moving said link lever to said coupled position relative to said actuator output lever to move said override release mechanism to said engaged position in response to a selective and/or non-normal condition.

19. The power latch assembly of claim 18, wherein movement of said cam lobe is facilitated by movement of a plurality of gears driven by said power release gear.

20. The power latch assembly of claim 19, wherein said plurality of gears includes a first gear configured in meshed engagement with a second gear, and a third gear configured for driven engagement with said power release gear and in meshed engagement with said second gear, said cam lobe being fixed to said first gear.

* * * * *